US008122627B2

(12) United States Patent
Miller

(10) Patent No.: US 8,122,627 B2
(45) Date of Patent: Feb. 28, 2012

(54) VENTILATED WASHABLE ELECTRONIC SIGN DISPLAY ENCLOSURE

(75) Inventor: Kent S. Miller, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 11/809,098

(22) Filed: May 31, 2007

(65) Prior Publication Data

US 2011/0072697 A1 Mar. 31, 2011

Related U.S. Application Data

(63) Continuation-in-part of application No. 10/948,769, filed on Sep. 23, 2004, now abandoned.

(51) Int. Cl.
*G09F 13/04* (2006.01)

(52) U.S. Cl. ..... 40/573; 312/265.5

(58) Field of Classification Search ..... 361/690–695, 361/679.48; 454/184; 40/570, 573; 392/348; 52/302.1; 312/100, 102, 265.5
See application file for complete search history.

(56) References Cited

U.S. PATENT DOCUMENTS 2,053,547 A 9/1936 Austin (Continued)

FOREIGN PATENT DOCUMENTS

DE 102005049211 A1 4/2007

(Continued)

OTHER PUBLICATIONS

"European Application Serial No. 08165445.1, European Search Report dated Mar. 16, 2009", 6 pgs.

(Continued)

*Primary Examiner* — Joanne Silbermann

(74) *Attorney, Agent, or Firm* — Schwegman, Lundberg & Woessner P.A.

(57) ABSTRACT

A ventilated washable electronic sign display enclosure having an intake duct and an exhaust duct located along the front thereof. The ventilated washable electronic sign display enclosure is geometrically configured to prevent or dissuade entry of fluid streams to the interior of the enclosure through the exhaust duct and through the intake duct. Combinations of vertically spaced vent tabs and vent spaces in the intake duct and the exhaust duct are incorporated to allow air flow freely therethrough and also provide through various relationships of structure to prevent or dissuade cleaning water streams from entry to the interior of the enclosure. An alternate embodiment provides a ventilated washable electronic sign display enclosure using formed components including formed full and partial width mid-panels supporting a protective shroud support and a plurality of angled protective shrouds having interchangeability accommodating features providing for rapid field installation assembly.

20 Claims, 15 Drawing Sheets

U.S. PATENT DOCUMENTS

| | | | | |
|---|---|---|---|---|
| 2,270,377 | A * | 1/1942 | McLauchlin | 40/592 |
| 3,594,761 | A | 7/1971 | Boesen | |
| 4,234,914 | A | 11/1980 | Boesen | |
| 5,172,504 | A | 12/1992 | De Maat et al. | |
| 5,268,828 | A | 12/1993 | Miura | |
| 5,321,417 | A | 6/1994 | Voelzke et al. | |
| 5,497,573 | A * | 3/1996 | Stadjuhar et al. | 40/564 |
| 5,647,152 | A | 7/1997 | Miura | |
| 5,692,855 | A | 12/1997 | Burton | |
| 5,709,045 | A * | 1/1998 | Thelen | 40/544 |
| 5,715,619 | A | 2/1998 | Polisois et al. | |
| 6,053,165 | A | 4/2000 | Butler et al. | |
| 6,154,945 | A | 12/2000 | Voelzke | |
| 6,314,669 | B1 | 11/2001 | Tucker | |
| 6,508,494 | B1 | 1/2003 | Reuter et al. | |
| 6,643,130 | B1 * | 11/2003 | DeMarchis et al. | 361/695 |
| 6,729,054 | B1 | 5/2004 | VanderTuin | |
| 6,795,315 | B1 * | 9/2004 | Wu et al. | 361/695 |
| 2003/0156828 | A1 | 8/2003 | Jamieson et al. | |
| 2003/0217495 | A1 | 11/2003 | Nagamine et al. | |
| 2005/0097792 | A1 | 5/2005 | Naden | |

FOREIGN PATENT DOCUMENTS

| | | | |
|---|---|---|---|
| WO | WO-2005/079129 | A1 | 8/2005 |
| WO | WO-2007/042197 | A2 | 4/2007 |

OTHER PUBLICATIONS

"European Application Serial No. 08165445.1, Response filed Sep. 23, 2009 to Official Communication dated Mar. 16, 2009", 2 pgs.

* cited by examiner

VENTILATED WASHABLE ELECTRONIC SIGN DISPLAY ENCLOSURE

CROSS REFERENCES TO RELATED APPLICATIONS

This patent application is a continuation-in-part of application Ser. No. 10/948,769 entitled "Ventilated Washable Electronic Sign Display Enclosure" filed on Sep. 23, 2004, now abandoned.

This application is related to U.S. utility patent application Ser. No. 10/688,304 entitled "Electronic Display Module Having a Four-Point Latching System for Incorporation into an Electronic Sign and Process" filed Oct. 17, 2003, now U.S. Pat. No. 7,055,271 B2 to Lutz et al., patented Jun. 6, 2006, which is incorporated herein by reference.

This application is also related to U.S. utility patent application entitled "Electronic Sign Having a Formed Metal Cabinet" Ser. No. 11/809,107, filed concurrently herewith, a copy of which is attached, and the disclosure of which is incorporated herein by reference.

BACKGROUND OF THE INVENTION

1. Field of the Invention

The present invention relates to electronic sign displays, but more particularly, refers to an electronic sign enclosure which is ventilated to provide for cooling of components contained inside the enclosure and which also provide structure to allow washing of the exterior of the electronic sign display without damage to the contained components therein.

2. Description of the Prior Art

Prior art electronic display enclosures often provided for ventilation of the components of an electronic sign, such as power supplies, driver boards, light emitting diode mounting boards, front viewing structures, and the like. Such ventilation schemes often included ventilation fans, ventilation ducts, ventilation holes, and other openings conducive to offering adequate ventilation to remove heat generated by electronic components and heat generated by environment heat sources. Often, environmental substances would hamper suitable viewing or operation of the electronic display due to buildup of dust, dirt, grime, smoke deposits, airborne particles of other composition, small insects, cobwebs, insect deposits, or other substances found in the environment. Such substances could detrimentally gather or be deposited upon viewable front structures of an electronic sign display, such as on exposed pixels, on exposed clear front protective panels, on or about louvers, or even about ventilation orifice structure. Several simple methods have been attempted to cleanse the structure of an electronic sign display from such substances. One such method could involve the use of small or large brooms, or like devices, but the use of such could be laborious or impractical due to the location of the electronic sign, or even by time constraints. Another method is by the use of water or other suitable fluid forcefully sprayed by a pressurized hose or other pressurized device. While the use of sprayed liquid streams can be highly effective for cleaning the exterior of an electronic sign display, fluids often found their way into the interior of the enclosure, thus being potentially harmful to the components inside. Hence, a problem exists wherein an electronic sign could be well sealed against cleansing by fluid spray and have, for the most, inadequate ventilation, or an electronic sign could be well ventilated at the expense of adequately sealed protective enclosure structure. Additionally, construction of such electronic signs is labor intensive, such as during factory fabrication where alignment coupled with drill matching and measurement procedures contribute to additional labor and cost. Onsite construction techniques were required for addition of upper level protective shrouds which bridge adjacent sign structures. Other construction procedures are often hampered by the use of extruded materials which are not always as straight and true as desired. The present invention offers structure addressing the problems encountered in prior art electronic signs or electronic sign enclosures by providing a ventilated washable electronic sign display enclosure, whereby adequate ventilation is provided and where structure is provided to thwart the entry of sprayed fluids thereinto. The use of formed structure contributes to uniformity of the sign structure.

SUMMARY OF THE INVENTION

The general purpose of the present invention is to provide a ventilated washable electronic sign display enclosure. The ventilated washable electronic sign display enclosure is provided having an intake duct and an exhaust duct located along the front thereof. Ventilation air is drawn into the intake duct at the lower front region of the enclosure for cooling of the enclosure and electronic components housed therein by the use of internal fans and is forced through the exhaust duct at the upper front region of the enclosure. The ventilated washable electronic sign display enclosure is geometrically configured to prevent or dissuade entry of fluid streams to the interior of the enclosure through the exhaust duct and through the intake duct. No moving parts are required nor is any reconfiguration, such as the closing of vents, required due to the unique attributes of the invention.

One part of the intake duct is formed by a lower front vent channel which is geometrically configured having horizontally aligned vent tabs alternating with interceding horizontally aligned vent spaces at its lower surface where the vent tabs align below vertically aligned vent orifices on a vertically aligned front panel of a bottom channel which is geometrically configured and which forms the other side of the intake duct. Incoming ventilation air passes through the vent spaces located between the vent tabs to pass upwardly and inwardly through the vent orifices on the vertically aligned front panel of the bottom channel and is dispersed about the interior of the enclosure. Interfering and shielding alignment of the vent tabs with the vertically aligned vent orifices on the vertically aligned front channel panel of the configured bottom channel dissuades or prevents entry of streams of liquid cleansing sprays through the vent orifices.

The exhaust duct at the top and front region of the enclosure is formed in part by a top channel which is geometrically configured and formed in part by an interspersed upper front vent channel which is geometrically configured. The upper front vent channel includes a horizontally aligned top panel having horizontally aligned vent tabs alternating with interceding horizontally aligned vent spaces. The top channel includes a horizontally oriented vent panel also having horizontally aligned vent tabs alternating with interceding horizontally aligned vent spaces which align to the rear panel of the upper front vent channel. Accordingly, the relationship of the vent spaces of the upper front vent channel is such that those vent spaces align with the underlying vent tabs of the top channel where the vent tabs are in interfering and shielding alignment in addition to shielding offered by the remaining area of the top panel of the upper front vent channel to prevent or dissuade fluid entry through those vent spaces and through a space between the top panel of the upper front vent channel and the top panel of the top channel. Also, the position of the vent tabs of the upper front vent channel is such that those vent tabs align with the underlying vent spaces of the top channel to prevent or dissuade entry of fluid upwardly through the underlying vent spaces of the vent panel on the top channel. Such component relationships and other relationships described herein dissuade or prevent fluid entry into the interior of the enclosure. Exhaust ventilation air passes along the top of the top channel and through a space leading to the top panel of the front vent channel and then downwardly through the upper front vent channel vent spaces located between the upper front vent channel vent tabs to pass downwardly and through the top channel vent spaces located between the top channel vent tabs on the horizontally aligned vent panel of the top channel and then is directed along an angled drip panel of the upper front vent channel to ambient air.

According to one embodiment of the present invention, there is provided a ventilated washable electronic sign display enclosure including a top channel, a bottom channel, right and left border panels extending between the top channel and the bottom channel, a rear panel, vertically aligned partial and full width mid panels, a forwardly located intake duct extending between the lower front regions of the left and right border panels, a forwardly located exhaust duct extending between the upper front regions of the left and right border panels, and a plurality of LED modules located between the opposed right and left border panels and the opposed exhaust duct and intake duct.

An alternative embodiment of the present invention is provided utilizing many of the principals and teachings of the first embodiment. The alternative embodiment features uniformly constructed protective shrouds which can be of standard lengths which are interchangeable with other like protective shrouds. The protective shrouds are used in the upper region of the ventilated washable electronic sign display enclosure where a first protective shroud mounts and secures centrally along the upper region of the ventilated washable electronic sign display enclosure without adjoining any other ventilated washable electronic sign display enclosures and where adjacent second and third protective shrouds mount and secure adjacent to and on each side of the first centrally located protective shroud and can bridgingly extend over and about adjacent ventilated washable electronic sign display enclosures or can be an end protective shroud. The use of components consisting of precision formed channels, precision formed panels, and the like can be incorporated into the first and second embodiments. The components are considered to be formed components being fashioned by precise cutting, stamping, bending, laser cutting, and the like to provide uniformly shaped components of close tolerance and fit which can be planar two dimensional components or which can be multiple faced multiple components in more than one plane.

According to one or more illustrations of an alternative embodiment of the present invention, there is provided a ventilated washable electronic sign display enclosure having a plurality of formed components, such as, but not limited to, one or more protective shrouds fitting fully or partially on a protective shroud support, a top vent channel, a front vent channel, a cable channel, a bottom channel, right and left border panels extending between the top vent channel and the bottom channel, a rear enclosure panel, vertically aligned partial and full width mid panels extending between the top vent channel and the bottom channel extending between the lower front regions of the left and right border panels, an LED mounting plate between the opposed right and left border panels, a plurality of LED modules secured to the LED mounting plate, and a plurality of filtered ventilation fans.

One significant aspect and feature of the present invention is a ventilated washable electronic sign display enclosure which is washable and which allows ventilation.

Another significant aspect and feature of the present invention is a ventilated washable electronic sign display enclosure having no moving parts.

Another significant aspect and feature of the present invention is a ventilated washable electronic sign display enclosure utilizing an intake duct which allows the intake of ventilation air but dissuades or prevents the entry of cleaning water streams through the intake duct to the interior of the enclosure.

Yet another significant aspect and feature of the present invention is a ventilated washable electronic sign display enclosure utilizing an exhaust duct which allows the exhausting of ventilation air but dissuades or prevents the entry of cleaning water streams through the exhaust duct to the interior of the enclosure.

A still further significant aspect and feature of the present invention is a ventilated washable electronic sign display enclosure having an intake duct which has a front panel aligningly located to dissuade or prevent water stream flow through vent orifices to the interior of the enclosure.

A further significant aspect and feature of the present invention is a ventilated washable electronic sign display enclosure having an intake duct which has alternating vent tabs and vent spaces where the alternating vent tabs are aligningly located to dissuade or prevent water stream flow through vent orifices to the interior of the enclosure.

A still further significant aspect and feature of the present invention is a ventilated washable electronic sign display enclosure having a front panel which is aligningly located to dissuade or prevent water stream flow through the exhaust duct to the interior of the enclosure.

A still further significant aspect and feature of the present invention is a ventilated washable electronic sign display enclosure having an angled drip panel which is aligningly located to dissuade or prevent water stream flow through the exhaust duct to the interior of the enclosure.

A further significant aspect and feature of the present invention is a ventilated washable electronic sign display enclosure having an exhaust duct which has alternating vent tabs and vent spaces in alternating and offset alignment with corresponding alternating vent tabs and vent spaces where the alternating vent tabs are aligningly located to dissuade or prevent water stream flow through the exhaust duct to the interior of the enclosure.

Additional significant aspects and features of the present invention are included in the first and second embodiments of the ventilated washable electronic sign display enclosures include formed metal components.

In the alternative embodiment:

A further significant aspect and feature of the present invention includes the use of protective shrouds having standard mounting features incorporating interchangeablity in attachment to an underlying protective shroud support.

A further significant aspect and feature of the present invention includes the use of interchangeable protective shrouds in combination with and supported by a protective shroud support.

Yet a further significant aspect and feature of the present invention includes the use of interchangeable protective shrouds which can reside solely on the protective shroud support of one ventilated washable electronic sign display enclosures or overlappingly residing as part of adjacent ventilated washable electronic sign display enclosures.

A further significant aspect and feature of the present invention is the overlapping of protective shrouds in adjacent sections of the invention to prevent moisture, water, dirt, insects, and the like from gaining entry between adjacent ventilated washable electronic sign display enclosures.

A further significant aspect and feature of the present invention is the use of a protective shroud having an angled top panel to promote the drainage of liquids, including, but not limited to, sodas, water, alcoholic beverages, and the like from the top of the protective shroud and discourages the placement of beverages in cans, bottles or cups, or other type objects thereupon due to the angled surface.

A further significant aspect and feature of the present invention is the preferable use of a plurality of rivets, and nut inserts, and machine screws, or combinations thereof to fasten adjacent formed components.

A further significant aspect and feature of the present invention is that no measuring or match drilling is required for assembly.

A further significant aspect and feature of the present invention is that the invention can be shipped for installation in the field with eyebolts extending though the top structure whereupon after installation the eye bolts are removed and several protective shrouds are installed for completion of the installation process.

Having thus briefly described embodiments of the present invention and having mentioned some significant aspects and features of the present invention, it is the principal object of the present invention to provide a ventilated washable electronic sign display enclosure.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
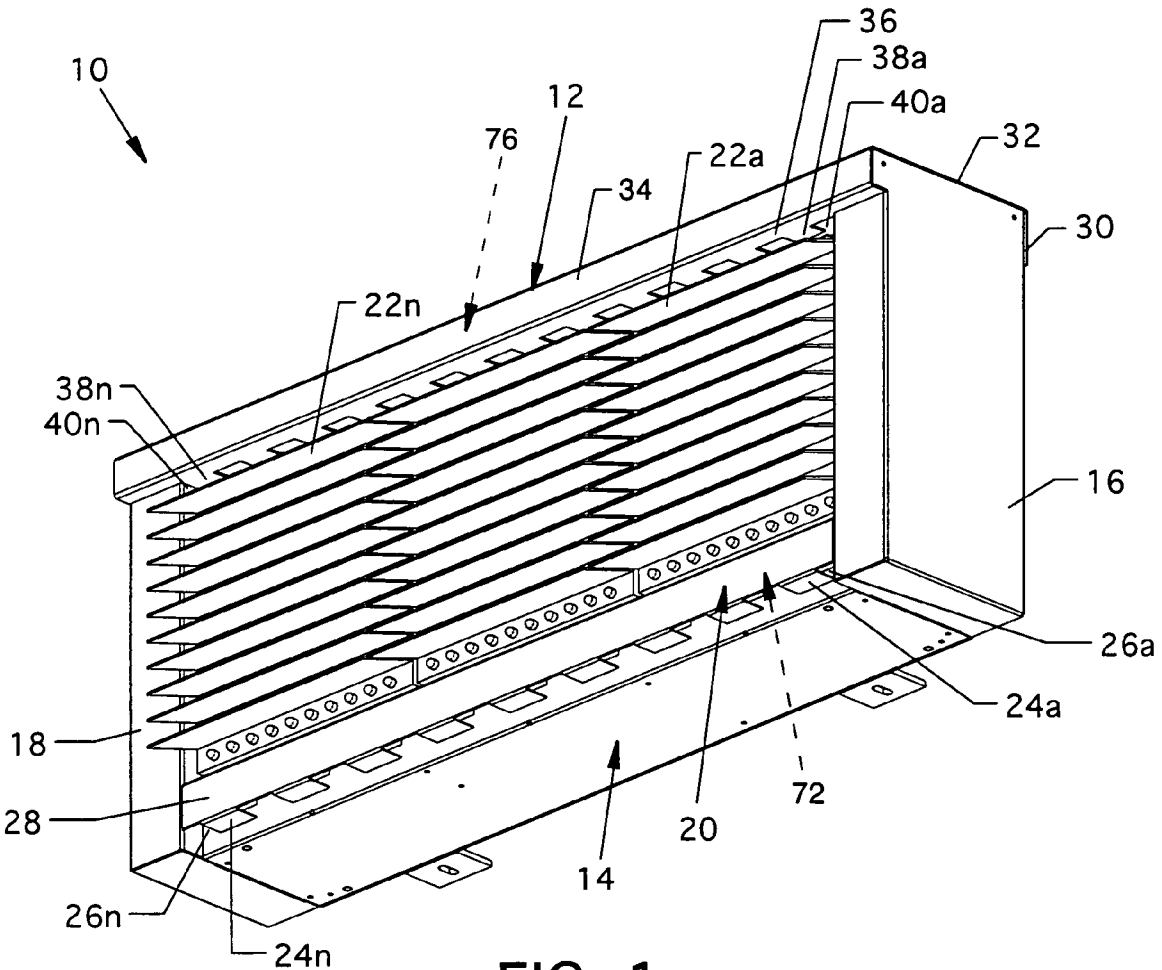
FIG. 1 is an isometric view of a ventilated washable electronic sign display enclosure, the present invention.

FIG. 1 is an isometric view of a ventilated washable electronic sign display enclosure 10, the present invention. Readily viewable assemblies, components or major structures of the ventilated washable electronic sign display enclosure 10 include a horizontally aligned top channel 12, a horizontally aligned bottom channel 14 opposing the top channel 12, a vertically aligned right border panel 16 and a vertically aligned left border panel 18 bridging the top channel 12 and the bottom channel 14, a horizontally aligned lower front vent channel 20 in intimate contact with one side of the bottom channel 14 and in alignment with the lower regions of the opposed right and left border panels 16 and 18, and a plurality of LED (light emitting diode) modules **22*a*-22*n* in alignment between the opposed right and left border panels 16 and 18 and in alignment between the forward region of the top channel 12 and the lower front vent channel 20. An intake duct 72 formed in part by the lower front vent channel 20 and an exhaust duct 76 formed in part by the forward portion of the top channel 12** are also shown.

The partially shown intake duct 72 at the lower region of the invention is formed partly by a plurality of horizontally oriented vent tabs **24*a*-24*n* and interceding vent spaces 26*a*-26*n* arranged in alternating fashion extending inwardly from the lower edge of a vertically aligned front panel 28 of the lower front vent channel 20 where each component thereof is a part of the intake duct 72. Structure at the upper region of the invention includes members of the top channel 12 having a rear panel 30, a top panel 32, a front panel 34, a vent panel 36 extending inwardly from the lower edge of the front panel 34, and a plurality of horizontally oriented vent tabs 38*a*-38*n* and interceding vent spaces 40*a*-40*n* arranged in alternating fashion extending inwardly from the lower edge of the front panel 34. The partially shown exhaust duct 76 is formed in part by part of the top panel 32, the front panel 34, the vent panel 36, and the plurality of horizontally oriented vent tabs 38*a*-38*n* and interceding vent spaces 40*a*-40*n***.

Figure 2:
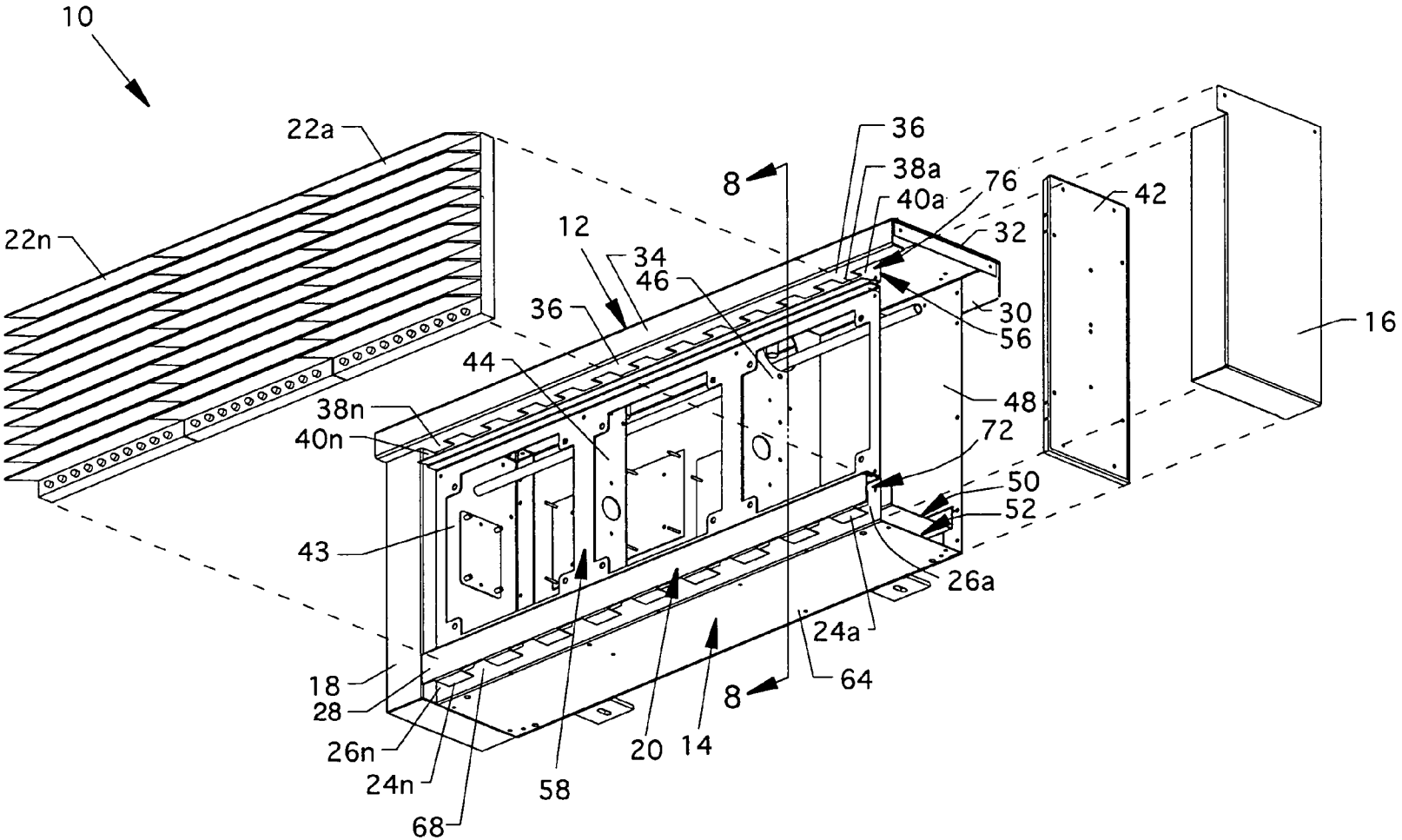
FIG. 2 is a semi-exploded isometric view of the ventilated washable electronic sign display enclosure.

FIG. 2 is a semi-exploded isometric view of the ventilated washable electronic sign display enclosure 10. FIG. 2 shows the present invention with the LED modules **22*a*-22*n* and the right border panel 16, as well as a right end panel 42 removed from the enclosure structure to reveal additional assemblies, components or major structures of the ventilated washable electronic sign display enclosure 10**.

Figure 3:
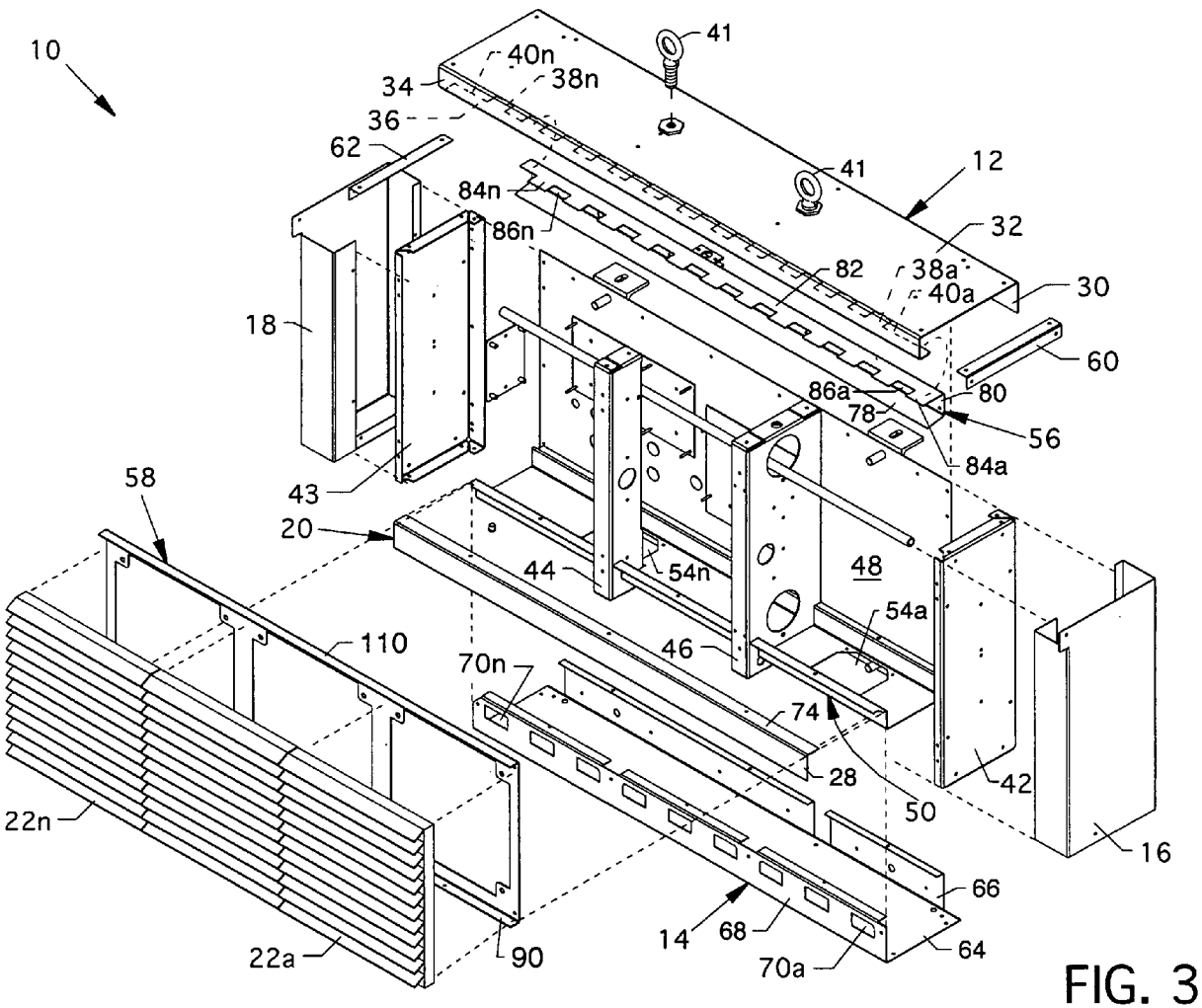
FIG. 3 is an exploded isometric view of the ventilated washable electronic sign display enclosure.

FIG. 3 is an exploded isometric view of the ventilated washable electronic sign display enclosure 10.

With reference to FIGS. 2 and 3, as well as understood reference to other figures shown herein, the structure of assemblies, components, major and other structures of the ventilated washable electronic sign display enclosure 10 is now described. Removable eyebolts 41 are located along the top panel 32. A variety of components attach and secure to centrally located vertically oriented panels within the central structure of the enclosure, such panels of which include a partial depth mid panel 44 and a full depth mid panel 46. Components that attach thereto or which are in close association therewith include an enclosure rear panel 48, right end panel 42, left end panel 43, a geometrically configured false bottom channel 50, the bottom channel 14, the lower front vent channel 20, the top channel 12, an upper front vent channel 56, an LED mounting plate 58, and various mounting plates for electronic components. Right and left corner brackets 60 and 62, respectively, secure to the ends of the top channel 12 to accommodate fastening of the upper regions of the right border panel 16 and the left border panel 18 thereto. Other regions of the right border panel 16 and the left border panel 18 secure over and about the right end panel 42 and the left end panel 43. The connective association of the majority of the above described components and the inclusion of the LED modules 22*a*-22*n* form an enclosure through which ventilation air can pass and which dissuades or prevents the entry of cleansing liquids.

The structures of the bottom channel 14 and the false bottom channel 50 at the lower region of the ventilated washable electronic sign display enclosure 10 combine to form a U-shaped and elongated lower chamber 52 extending along the length of the ventilated washable electronic sign display enclosure 10. The false bottom channel 50 includes a plurality of fan mounting orifices 54*a* 54*n*. The bottom channel 14 includes a bottom panel 64, a rear panel 66, and a front panel 68 having a plurality of spaced vent orifices 70*a*-70*n* (FIG. 3) located and aligned thereupon in communication with the elongated lower chamber 52. The bottom channel 14, the false bottom channel 50, the top channel 12, the right end panel 42, the left end panel 43, the right border panel 16, the left border panel 18, the partial depth mid panel 44, the full depth mid panel 46, and the LED mounting plate 58 each includes appropriately located flanges, as shown, for mating to adjacent components.

The intake duct 72 (FIG. 2), shown later in detail in FIGS. 5 and 8 at the lower region of the enclosure, is formed by the lower front vent channel 20, the front panel 68 of the bottom channel 14, and a flange 90 of the LED mounting plate 58. The lower front vent channel 20 includes a horizontally aligned top panel 74, the vertically aligned front panel 28, and the plurality of horizontally oriented and inwardly extending spaced vent tabs 24*a*-24*n* and spaced interceding vent spaces 26*a*-26*n* between the spaced vent tabs 24*a*-24*n* arranged in alternating fashion where the vent tabs 24*a*-24*n* and the vent spaces 26*a*-26*n* extend inwardly from the lower edge of the vertically aligned front panel 28 of the lower front vent channel 20 to meet the front panel 68 of the bottom channel 14.

The exhaust duct 76, shown later in detail in FIGS. 7 and 8 at the upper region of the enclosure, is formed by the upper front vent channel 56 and forwardly located portions of the top channel 12. The upper front vent channel 56 includes an angled drip panel 78 located at the lower portion thereof, a vertically aligned rear panel 80, and a horizontally aligned top panel 82. A plurality of horizontally oriented and outwardly extending spaced vent tabs 84*a*-84*n* and spaced interceding vent spaces 86*a*-86*n* between the spaced vent tabs 84*a*-84*n* are arranged in alternating fashion, each extending outwardly as part of the top panel 82 of the upper front vent channel 56.

Figure 4:
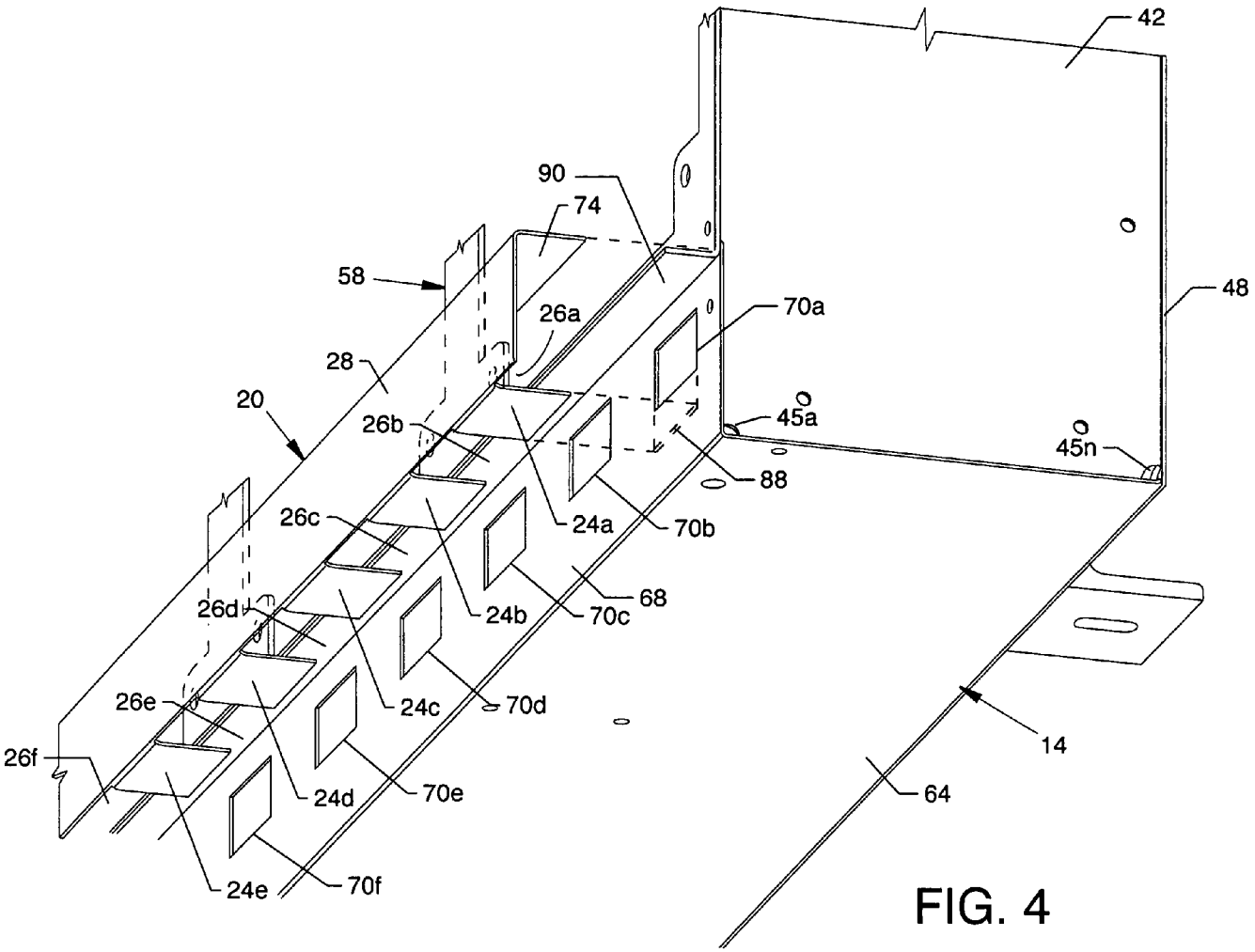
FIG. 4 is a partial view of the lower front vent channel alignigly distanced from the front panel of the bottom channel.

FIG. 4 is a partial view of the lower front vent channel 20 aligningly distanced from the front panel 68 of the bottom channel 14. The top panel 74 of the lower front vent channel 20 secures and aligns over a lower flange 90 extending from the lower edge of the LED mounting plate 58, as also shown in FIGS. 5 and 8. Noted in particular is the alignment of the inner edge of the vent tab 24*a* to the front panel 68 at a location represented by dashed lines 88 where such a location is distanced a short distance below the vent orifice 70*a*. The horizontally aligned vent tab 24*a* maintains a vertically aligned offset and angular relationship below the vent orifice 70*a*, as best shown in FIG. 5. All of the vent tabs 24*a*-24*n* have the same relationship and align in the same manner with respect to the vent orifices 70*a*-70*n*. Such a relationship dissuades or prevents the entry of water streams into and through the vent orifices 70*a*-70*n* of the intake duct 72 by interfering placement of the vent tabs 24*a*-24*n* in near and aligned proximity to the vent orifices 70*a*-70*n* to act as barriers to prevent water stream flow through the vent orifices 70*a*-70*n*. Also visible at the lower corners of the right end panel 42 are a plurality of weep holes 45*a*-45*n* for drainage of errant moisture.

Figure 5:
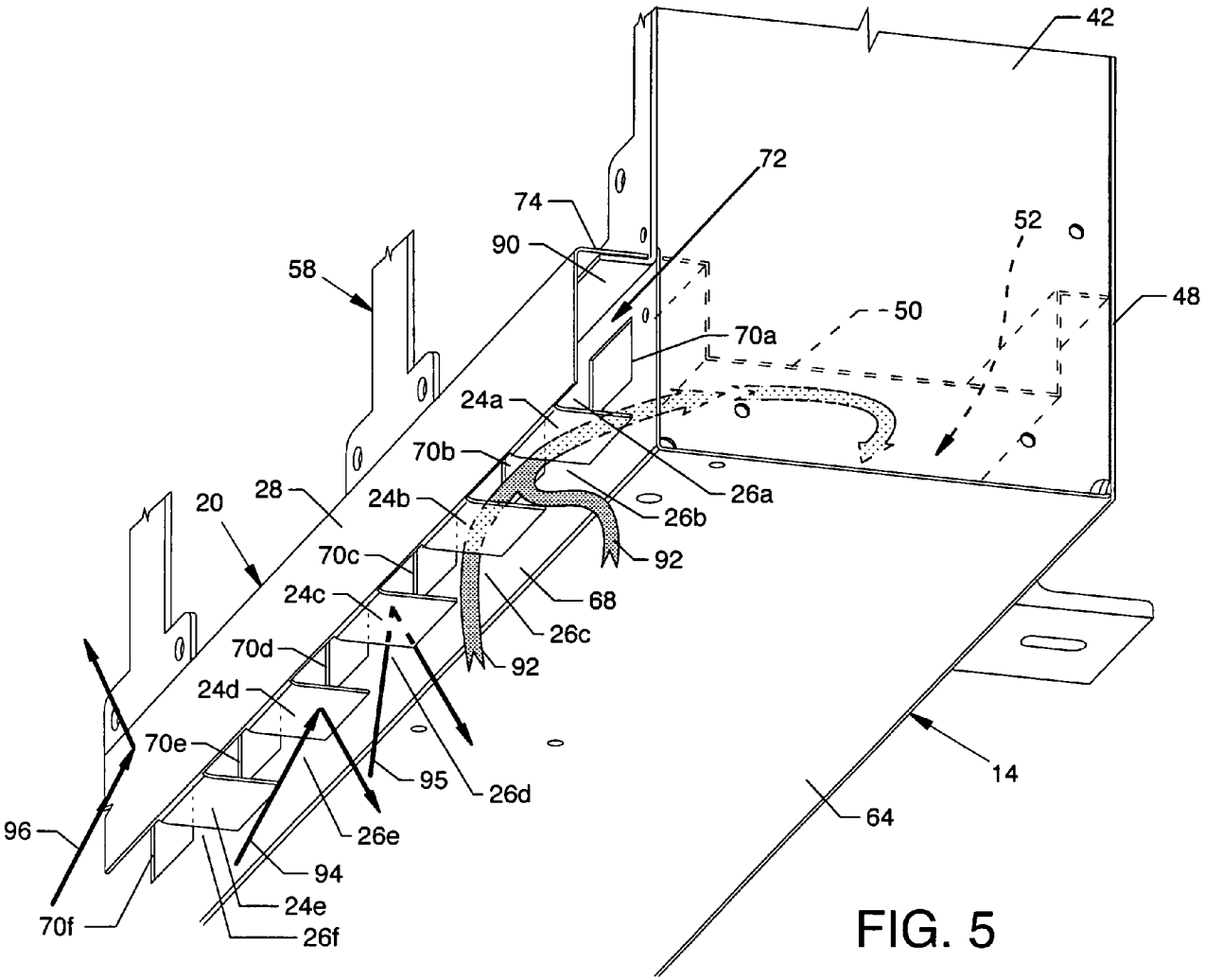
FIG. 5 is a partial view of the lower front vent channel in close association with and aligned to the front panel of the bottom channel to partially form an intake duct.

FIG. 5 is a partial view of the lower front vent channel 20 secured to the lower flange 90 in close association with and aligned to the front panel 68 of the bottom channel 14 to form, in part, the intake duct 72. The intake duct 72 is formed by the combination of the front panel 68 including vent orifices 70*a*-70*n* with the lower front vent channel 20 including the top panel 74, the front panel 28, the vent tabs 24*a*-24*n*, the vent spaces 26*a*-26*n*, and the lower flange 90 of the LED mounting plate 58.

The relationship of the components of the intake duct 72 is multipurpose in nature. One purpose is to allow air to be drawn through the structure of the intake duct 72. Another purpose is to allow streams of jetted water to come into intimate contact with the outer regions of the ventilated washable electronic sign display 10, such as in close proximity to the intake duct 72, for the purpose of cleaning, and also to dissuade or prevent the infusion of such jetted water into the intake duct 72 and the elongated lower chamber 52.

A typical path of intake airflow 92, such as found along the length of the intake duct 72, is shown in detail flowing around and about and on each side of the vent tab 24*b* and through the adjacent vent spaces 26*b* and 26*c* to move upwardly and sideways to the area just above the vent tab 24*b*, which is in vertical alignment with the vent orifice 70*b* just above the inward edge of the vent tab 24*b*. Flow then continues through the vent orifice 70*b* and into the elongated lower chamber 52 for redirection by one or more fans about the enclosure interior for cooling of the components housed therein.

Typical paths of water stream which encounter situations showing rejection of water streams 94, 95 and 96 are also illustrated, such as can occur at locations along the length of the intake duct 72. One aimed water stream 94 first encounters and impinges the vent tab 24*d* to be deflected therefrom away from entry into the intake duct 72 so as to preclude entry into the vent orifice 70*d*. Another water stream 95 can pass into the intake duct 72 through the vent space 26*d* between the vent tabs 24*c* and 24*d* to encounter and impinge the front panel 68 at the lower region of the panel 68 or at the region of the panel 68 between the vent orifices 70*c* and 70*d* to be deflected therefrom. The flow of the water stream 95 may dissipate and flow overboard at this conjuncture, but if the velocity is of sufficient strength, the flow may continue where the water path 95 is deflectingly redirected to impinge the lower flange 90 and/or the top panel 74 and then, if dissipated, flow overboard or continue for possible reflective rearward impingement of the front panel 28. Such redirected scattering and slowing of the water stream allows the water to evacuate the interior of the intake duct 72 by gravitational assistance either by flowing as a water stream back through the vent space 26*d* or by deposition and subsequent drainage flow overboard, such as upon and along the surfaces of the intake duct 72, most of which are inwardly facing. Another water stream encounter situation is effected by the front panel 28 of the lower front vent channel 20 where the front panel 28 thereof is interferingly located in the path of an incoming water stream 96 to block the water stream flow where the aimed water stream 96 is deflected to dissuade or prevent entry of the water stream flow into structure behind the front panel 28 such as, but not limited to, the plurality of vent orifices 70*a*-70*n*.

Figure 6:
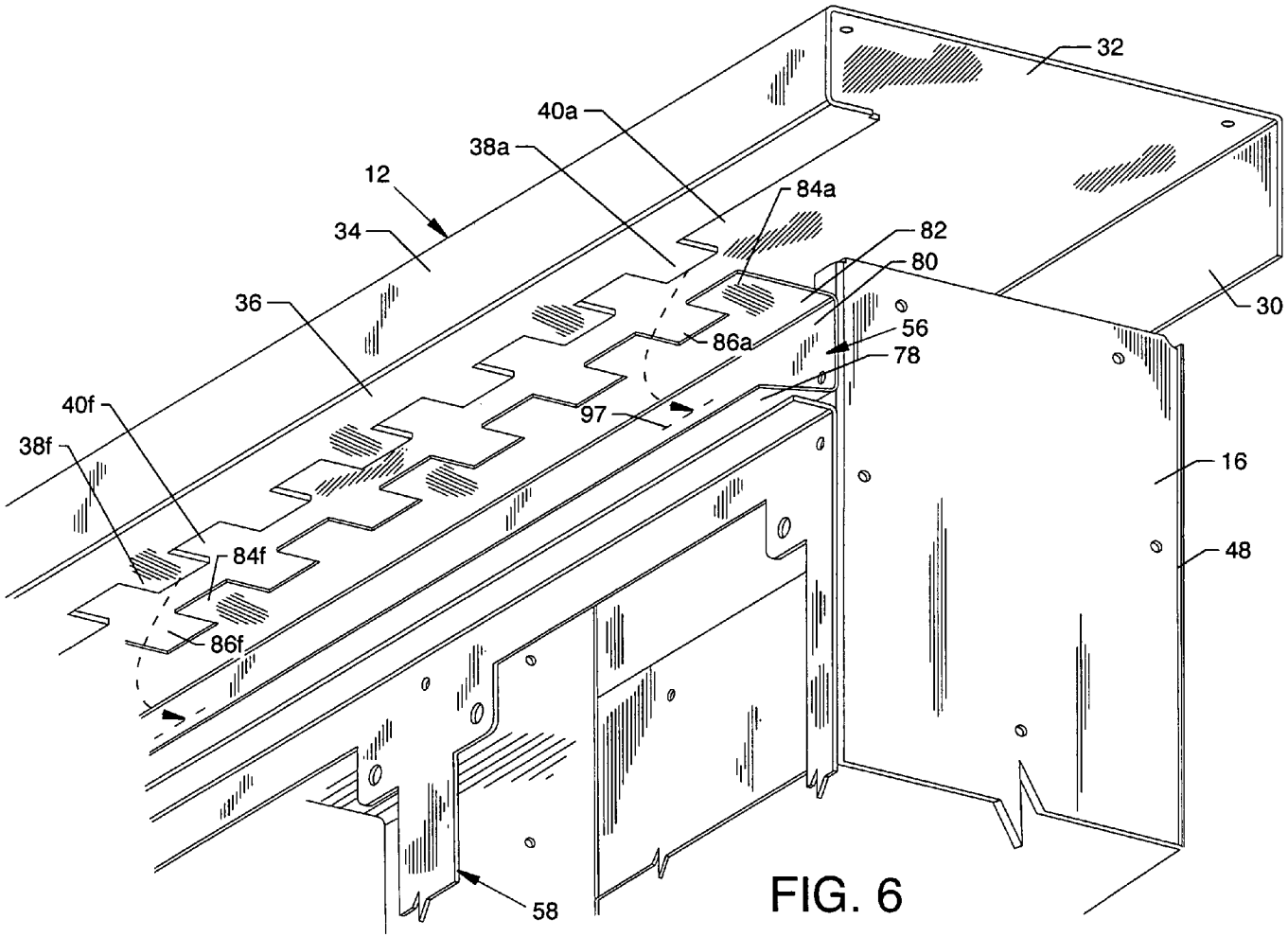
FIG. 6 is a view showing the structure of the top channel distanced from the structure of the upper front vent channel.

FIG. 6 is a view showing the structure of the top channel 12 distanced from the structure of the upper front vent channel 56. Noted in particular is the alignment of the inner edge of the vent tab 38*a* which extends inwardly from the vent panel 36 of the top channel 12 to interlacingly meet the rear panel 80 of the upper front vent channel 56 at a location represented by dashed lines 97 where such a location is distanced substantially along the mid portion of the rear panel 80. All of the vent tabs 38*a*-38*n* and included vent spaces 40*a*-40*n* have the same relationship and align in the same manner with respect to the mid portion of the rear panel 80 and, as such, the tabs 38*a*-38*n* and included vent spaces 40*a*-40*n* extend inwardly from the vent panel 36 of the top channel 12 and maintain a vertical spaced relationship and a horizontal offset relationship with and below the vent tabs 84*a*-84*n* and included vent spaces 86*a*-86*n* extending outwardly from the top panel 82 of the upper front vent channel 56, as shown in FIGS. 7 and 8.

Figure 7:
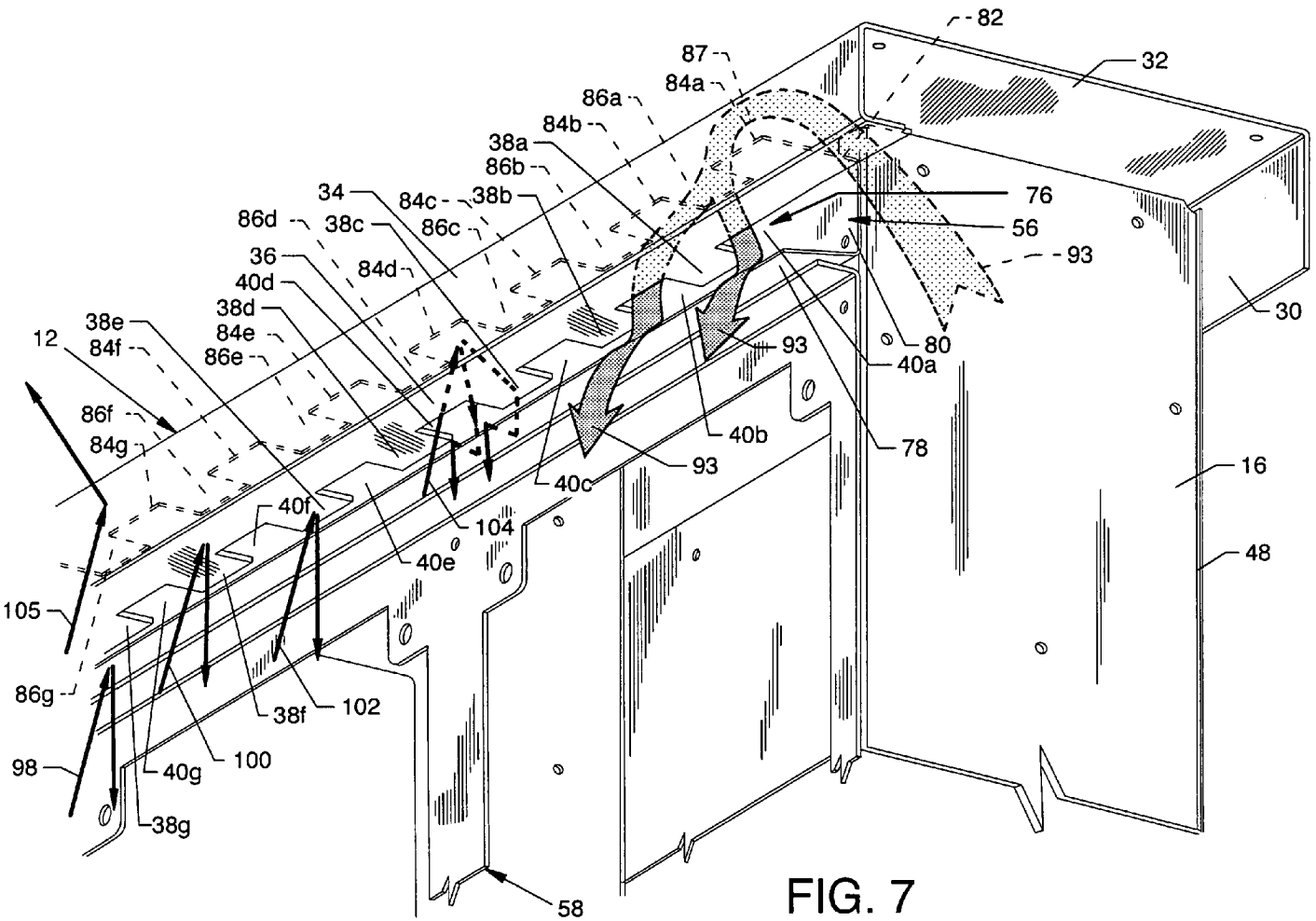
FIG. 7 is a partial view of the forward upper region of the top channel in close association with and aligned to the rear panel of the upper front vent channel.

FIG. 7 is a partial view of the forward upper region of the top channel 12 secured to the right border panel 16 using the right corner bracket 60 (not shown) in close association with and in interlaced alignment at the rear panel 80 of the upper front vent channel 56 in the manner described in FIG. 6 to form, in part, the exhaust duct 76. The exhaust duct 76, also shown in FIG. 8, is formed by the interlaced components in combination consisting of: the forward region of the top channel 12 including the forward part of the top panel 32, the front panel 34, the vent panel 36, the vent tabs 38*a*-38*n*, the vent spaces 40*a*-40*n*, and a greater portion of the upper front vent channel 56, including the upper portion of the rear panel 80, the top panel 82, the vent tabs 84*a*-84*n*, and the vent spaces 86*a*-86*n*.

The relationship of the components of the exhaust duct 76 is multi purpose in nature. One purpose is to allow exhaust air to be forced through the structure of the exhaust duct 76. Another purpose is to allow streams of jetted water to come into intimate contact with the outer regions of the ventilated washable electronic sign display 10, such as in close proximity to the exhaust duct 76, for the purpose of cleaning, and also to dissuade or prevent the infusion of such jetted water into the exhaust duct 76 and upper regions of the enclosure.

A typical path of exhaust airflow 93, such as can occur at other locations along the length of the exhaust duct 76, traverses from a mid location within the enclosure to pass horizontally and through an elongated airflow space 87 located between the top panel 82 of the upper front vent channel 56 and the forward region of the top panel 32 of the top channel 12, then along and about and thence between the vent tabs 84*a* and 84*b* through vent space 86*a*, then about the vent tab 38*a* and through the vent spaces 40*a* and 40*b* at the sides of the vent tab 38*a* to the region overlying the angled drip panel 78, and thence to ambient.

Several relationships dissuade or prevent entry of directed water streams into the interior regions of the exhaust duct 76. In one relationship, a first water stream encounter situation, a water stream 98 impinges and is deflected by the angled drip panel 78 of the upper front vent channel 56 away from entry into the internal regions of the exhaust duct 76.

Other relationships occur where the horizontal offset relationship of the vent tabs and vent spaces is such that each vent space is spacingly aligned to a vent tab.

A second water stream encounter situation is effected by the continuous portion of the vent panel 36 outboard of the spaced vent tabs 38*a*-38*n* and vent spaces 40*a*-40*n* where a directed water stream 100 impinges and is deflected away from entry into the internal regions of the exhaust duct 76. In such a situation, the continuous outboard portion of the vent panel 36 is interferingly located in the path of the incoming water stream 100 aimed at the exhaust duct 76 to stem the water stream flow thereinto. In the illustration, the outboard portion of the vent panel 36 blocks the flow of water stream 100 into the vent space 86*f*.

A third water stream encounter situation is effected by the spaced vent tabs 38*a*-38*n* where a directed water stream 102 impinges and is deflected by one of the closely located spaced vent tabs 38*a*-38*n* away from entry into the internal regions of the exhaust duct 76. In such a situation, the horizontal offset relationship of the vent tabs 38*a*-38*n* of the top channel 12 to the vent spaces 86*a*-86*b* of the upper front vent channel 56 is such that the vent tabs 38*a*-38*n* are interferingly located in the path of the incoming water stream 102 to block the water stream flow to the vent spaces 86*a*-86*n* to thus stem the water stream flow thereinto. In the illustration, vent tab 38*e* blocks the flow of water stream 102 into vent space 86*e*.

A fourth water stream encounter situation is effected by vent tabs 84*a*-84*n* where a directed water stream 104 impinges and is deflected where the water stream 104 passes through one of the vent spaces 40*a*-40*n*. In such a situation, the aligned relationship of the vent tabs 84*a*-84*n* of the upper front vent channel 56 to the vent spaces 40*a*-40*n* of the top channel 12 is such that the vent tabs 84*a*-84*n* are interferingly located in the path of the incoming water stream 104 to block the water stream flow aimed through the vent spaces 40*a*-40*n* to thus stem the flow of the water stream 104 into the interior of the enclosure. In the illustration, the water stream 104 passes through the vent space 40*d* where the flow of the water stream 104 is blocked by the vent tab 84*d* from flowing into the interior of the enclosure. Drainage of the deflected flow of the water stream 104 can take place directly through the vent space 40*d* or can flow along a vent tab 38*c* where in either case the flow can continue overboard along the angled drip panel 78, as shown.

A fifth water stream encounter situation is effected by the front panel 34 of the top channel 12 where the front panel 34 is interferingly located in the path of an incoming water stream 105 to block the water stream flow (not illustrated) where the aimed water stream impinges and is deflected to dissuade or prevent entry of the water stream flow into structure behind the front panel 34 such as, but not limited to, the plurality of vent tabs 84*a*-84*n* and the plurality of vent spaces 86*a*-86*n*.

Figure 8:
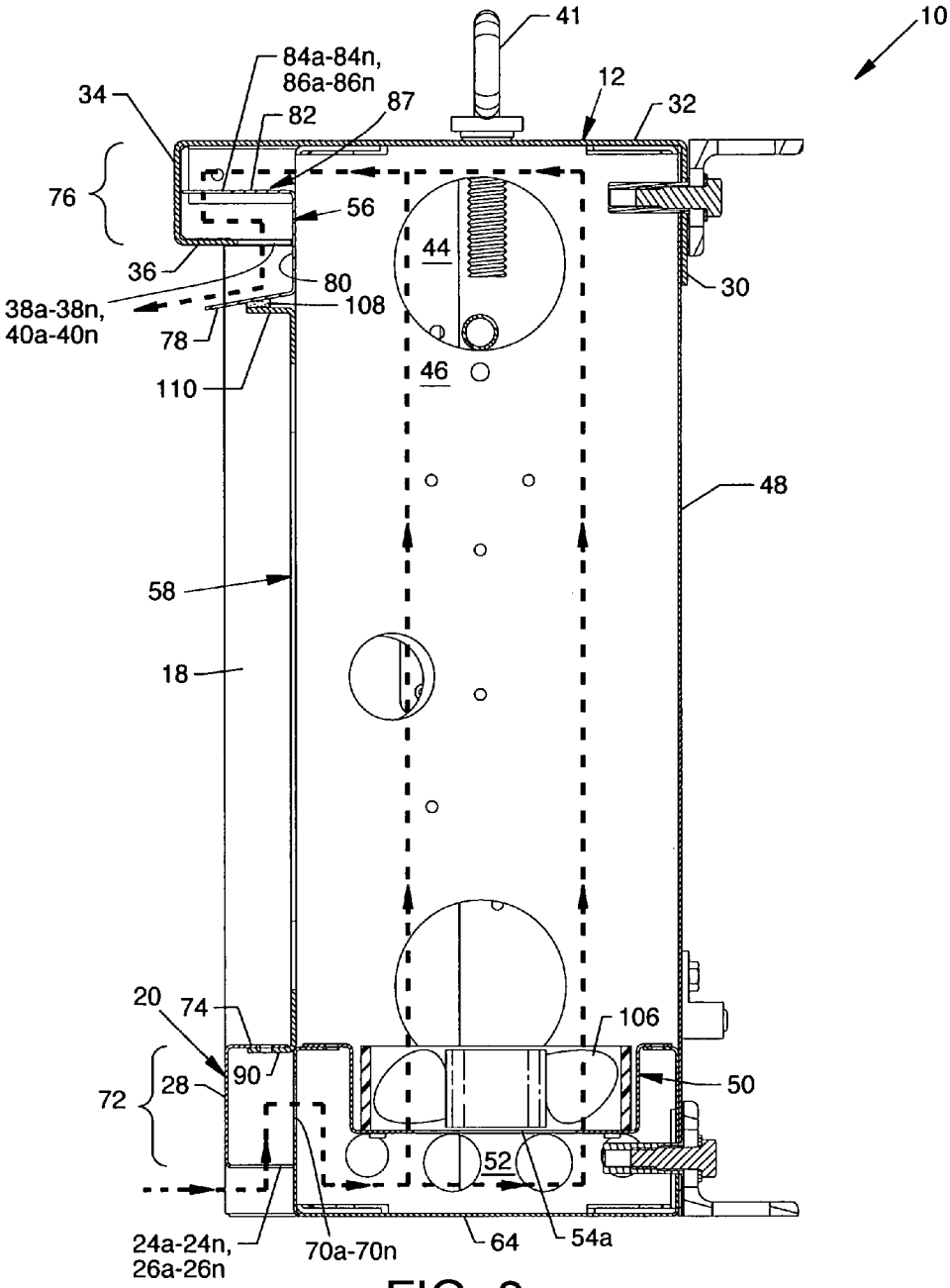
FIG. 8 is a cross section view of the ventilated washable electronic sign display enclosure along line 8-8 of FIG. 2.

FIG. 8 is a cross section view of the ventilated washable electronic sign display enclosure 10 along line 8-8 of FIG. 2. The LED modules 22*a*-22*n* are not shown for purposes of brevity and clarity. Airflow, in general, through the structure is shown by dashed lines and arrows where ventilation air enters through the intake duct 72 through the vent spaces 26*a*-26*n* and passes through the vent orifices 70*a*-70*n*, through the elongated lower chamber 52, through the fan mounting orifice 54*a*, through a fan 106, through the structure interior, through the airflow space 87 above the upper front vent channel 56, and thence through the appropriate portions of the exhaust duct 76, as shown in detail in FIG. 7. A seal 108 is also shown between the angled drip panel 78 of the upper front vent channel 56 and the upper flange 110 of the LED mounting plate 58.

MODE OF OPERATION OF ONE EMBODIMENT OF THE INVENTION

Personnel can clean the ventilated washable electronic sign display enclosure 10 by simply directing a water stream such as that produced for example by a garden hose, a high pressure washer device, or other such apparatus. Streams of water can be incorporated to wash away dirt, small debris, insects, bugs and the like from the LED modules 22*a*-22*d* with little worry concerning errant water streams proceeding past the intake duct 72 or the exhaust duct 76, as water streams are dissuaded or prevented from entry thereinto, as explained in detail with reference to FIGS. 5 and 7.

Figure 9:
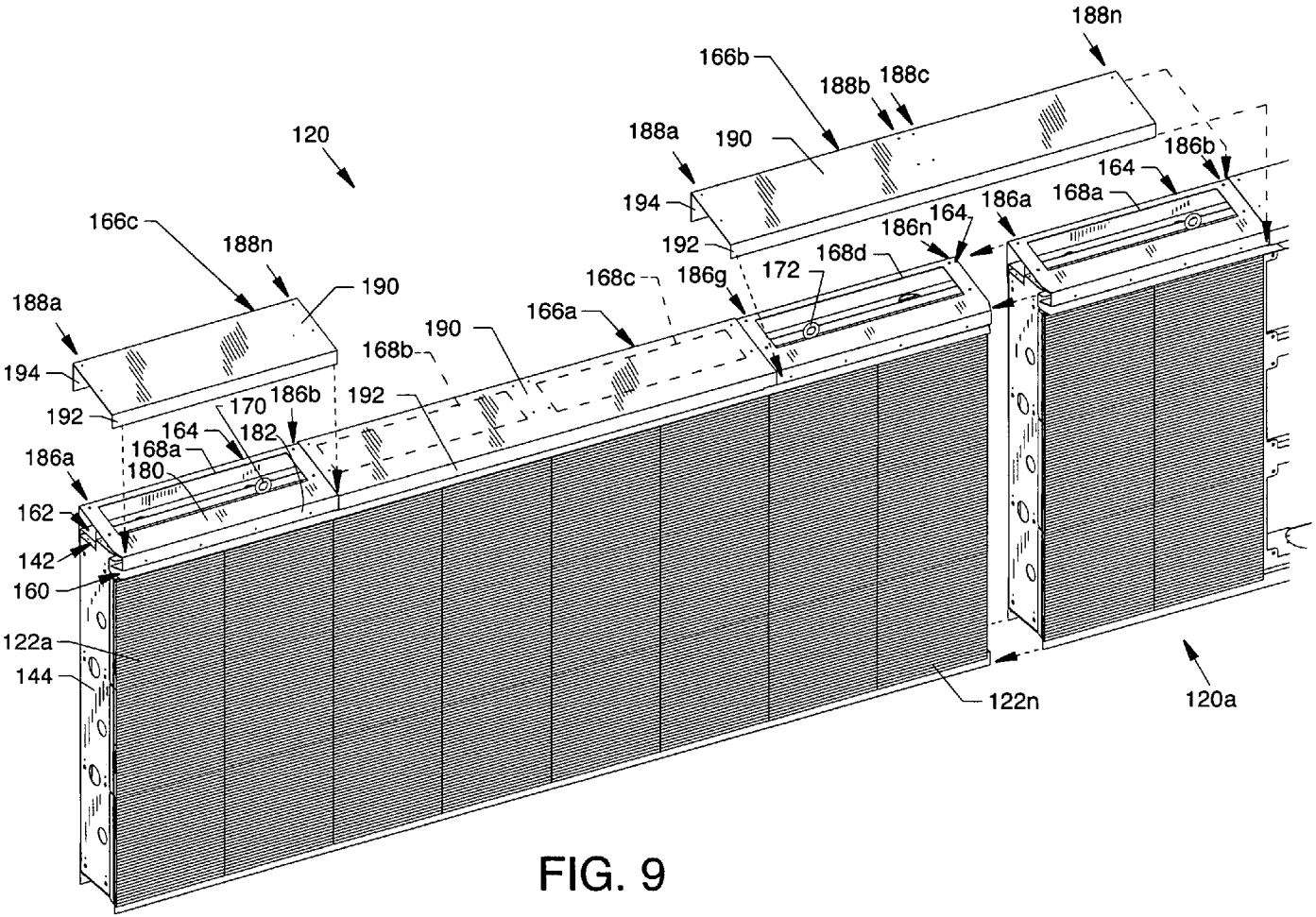
FIG. 9, an alternative embodiment, is a front isometric view of a ventilated washable electronic sign display enclosure.

FIG. 9, an alternative embodiment, is a front isometric view of a ventilated washable electronic sign display enclosure 120, the present invention, in use with a plurality of electronic display modules having a four-point latching system, herein referred to as the LED modules 122*a*-122*n*, removably attached to the front of the ventilated washable electronic sign display enclosure 120.

Figure 10:
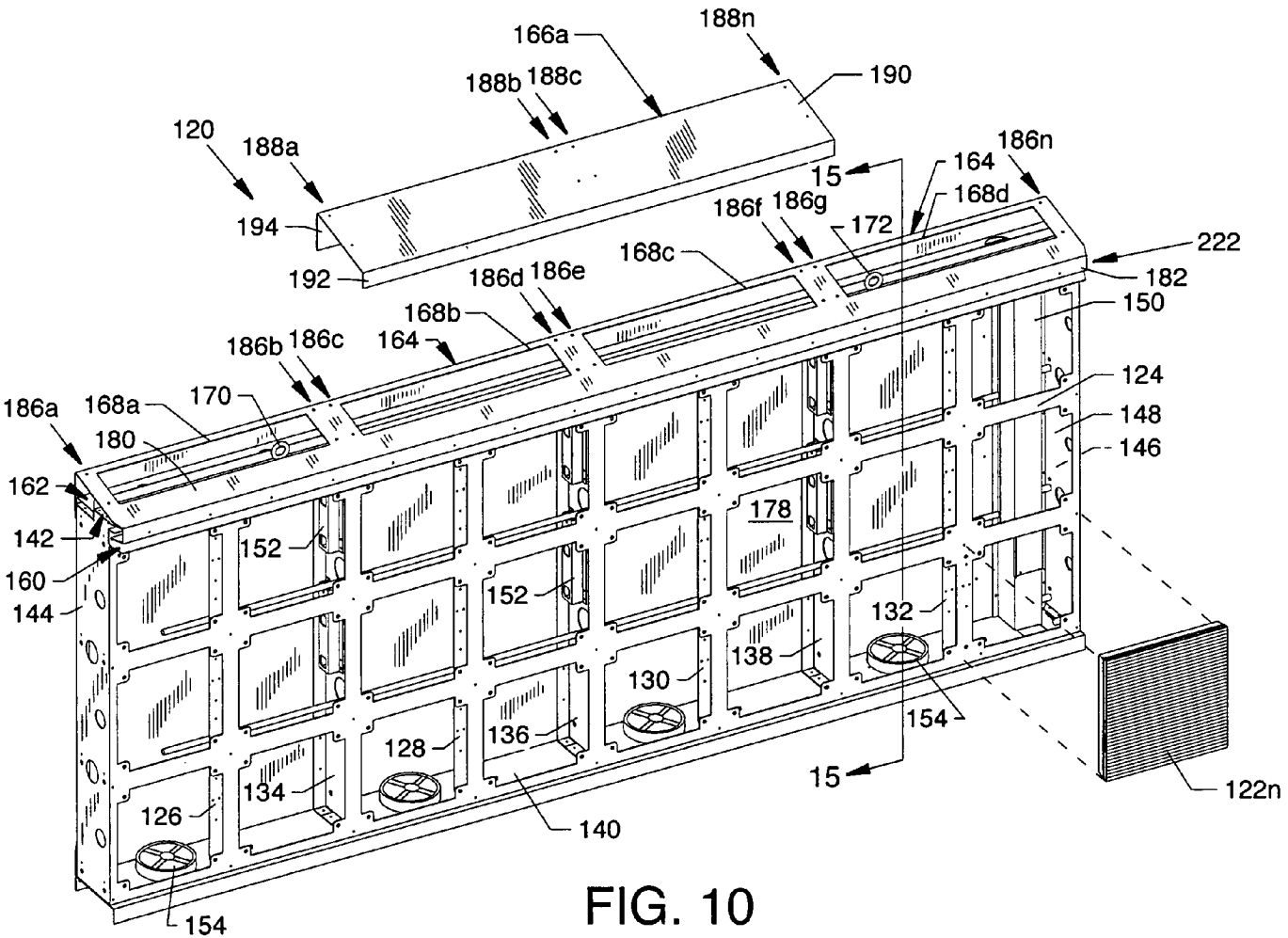
FIG. 10 is a front isometric view of the ventilated washable electronic sign display enclosure where a display module is shown distanced from an LED mounting plate.

FIG. 10 is a front isometric view of the ventilated washable electronic sign display enclosure 120 where only one display module 122*n* is shown being distanced from an LED mounting plate 124. The LED mounting plate 124, which can also be described as a mounting panel, is a part of the ventilated washable electronic sign display enclosure 120 and is used to mount the plurality of display modules 122*a*-122*n*. The relationship of the LED modules 122*a*-122*n* and the LED mounting plate 124 is described in U.S. Pat. No. 7,055,271 entitled "Electronic Display Module Having a Four-Point Latching System for Incorporation into an Electronic Sign and Process". Other components forming the ventilated washable electronic sign display enclosure 120 are viewable through the structure of the LED mounting plate 124 and at the ends and are described later in detail, whereby reference to FIG. 11 and other figures is beneficial.

Figure 11:
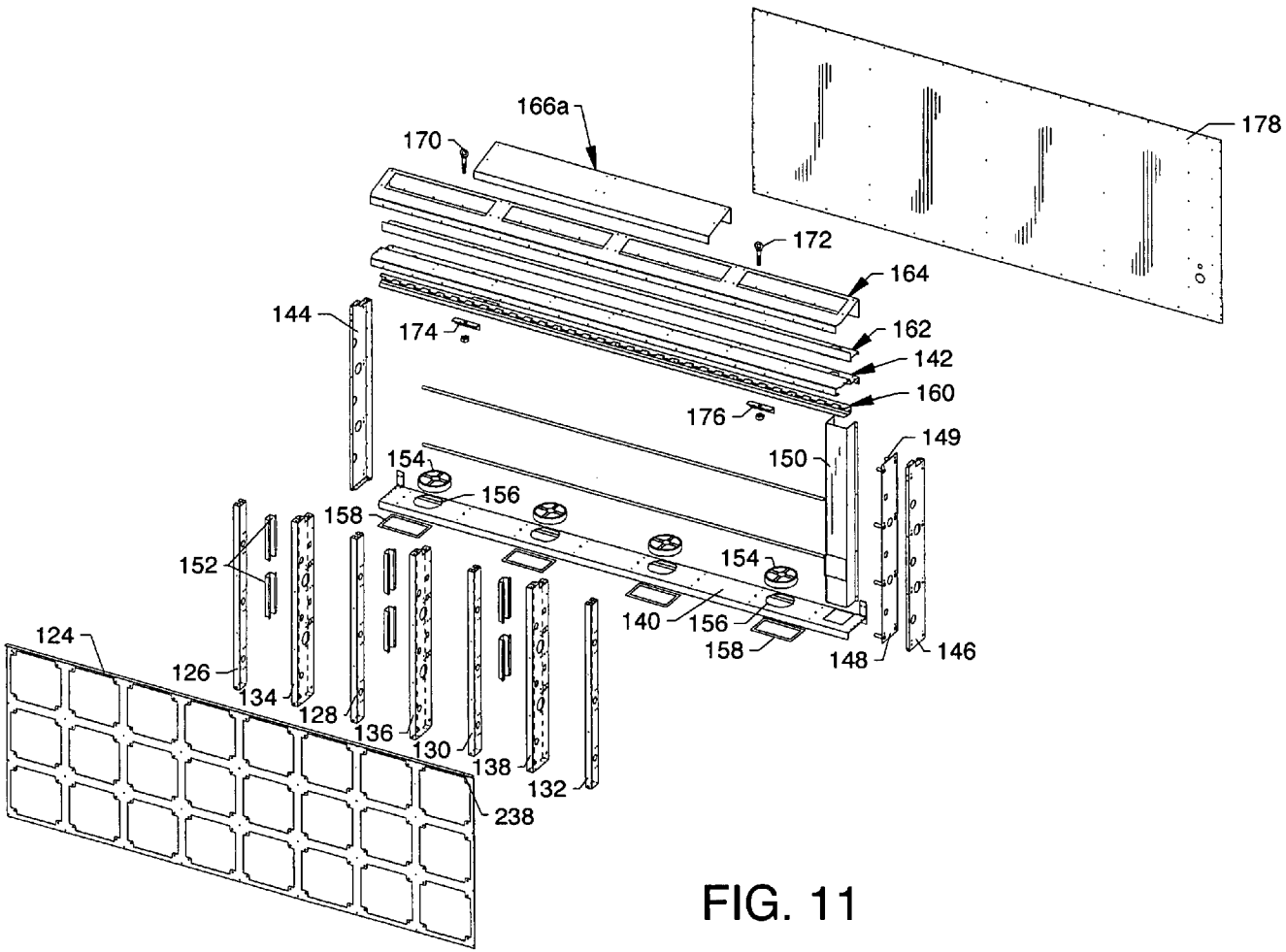
FIG. 11 is an exploded isometric front view of the ventilated washable electronic sign display enclosure.

FIG. 11 is an exploded isometric front view of the ventilated washable electronic sign display enclosure 120. With reference to FIGS. 9, 10 and 11 and with reference to other figures, the present invention is further described. The majority of the components of both embodiments of the present invention can be considered to be formed components, whereby fashioning thereof is accomplished by one or more methods, including, but not limited to, punching or bending or laser cutting or combinations thereof with great precision, close tolerance, and uniformity where such components can be a panel or a channel or other associated structure, each being utilized to facilitate rapid component assembly to produce a ventilated washable electronic sign display enclosure 120 having geometric uniformity and conformity. In general, the components of the invention are mutually and appropriately secured, such as by rivets, except as otherwise denoted. Pluralities of centrally located vertically aligned partial width mid-panels 126, 128, 130 and 132 and pluralities of centrally located vertically aligned full width mid-panels 134, 136 and 138 are arranged in alternating fashion extending and appropriately secured between a horizontally aligned bottom channel 140 and a horizontally aligned top vent channel 142. The partial width mid-panels 126, 128, 130 and 132 and the full width mid-panels 134, 136 and 138 of the present invention are referred to in closely related terms as formed mid-channels and formed channels, respectively, in a related U.S. utility patent application entitled "Electronic Sign Having a Formed Metal Cabinet" Ser. No. 11/809,107, filed concurrently herewith, a copy of which is attached and the disclosure of which is incorporated herein by reference.

A vertically aligned left border panel 144 and an opposite vertically aligned right border panel 146 approximating the general profile, shape and structure of the full width mid panels 134, 136 and 138 and a vertically aligned cable channel 150 extend and appropriately secure between the ends of the horizontally aligned bottom channel 140 and the ends of the horizontally aligned top vent channel 142. A right end panel 148 secures to the inner surface of the right border panel 146. The right end panel 148 includes a plurality of nut inserts 149 used for accommodation of machine screws extending through a left border panel 144 of an adjacent ventilated washable electronic sign display enclosure 120*a* (FIG. 9) and through the right border panel 146 for fastening of the adjacent ventilated washable electronic sign display enclosure 120*a* thereto. The partial width mid-panels 126, 128, 130 and 132, the full width mid-panels 134, 136 and 138, the left and right border panels 144 and 146, and the vertically aligned cable channel 150 include lips for fastening to other adjacent structures. A plurality of like electronic component mounting brackets 152 secure to one side of the full width mid-panels 134,136 and 138. A plurality of fans 154 align to a plurality of large opening 156 in the bottom channel 140 and a plurality of filter assemblies 158 align to the plurality of large openings 156 in the bottom channel 140, whereby ventilation air is provided for cooling of the LED modules 122*a*-122*n* and for the dissipation of heat from the interior of the ventilated washable electronic sign display enclosure 120.

Figure 15:
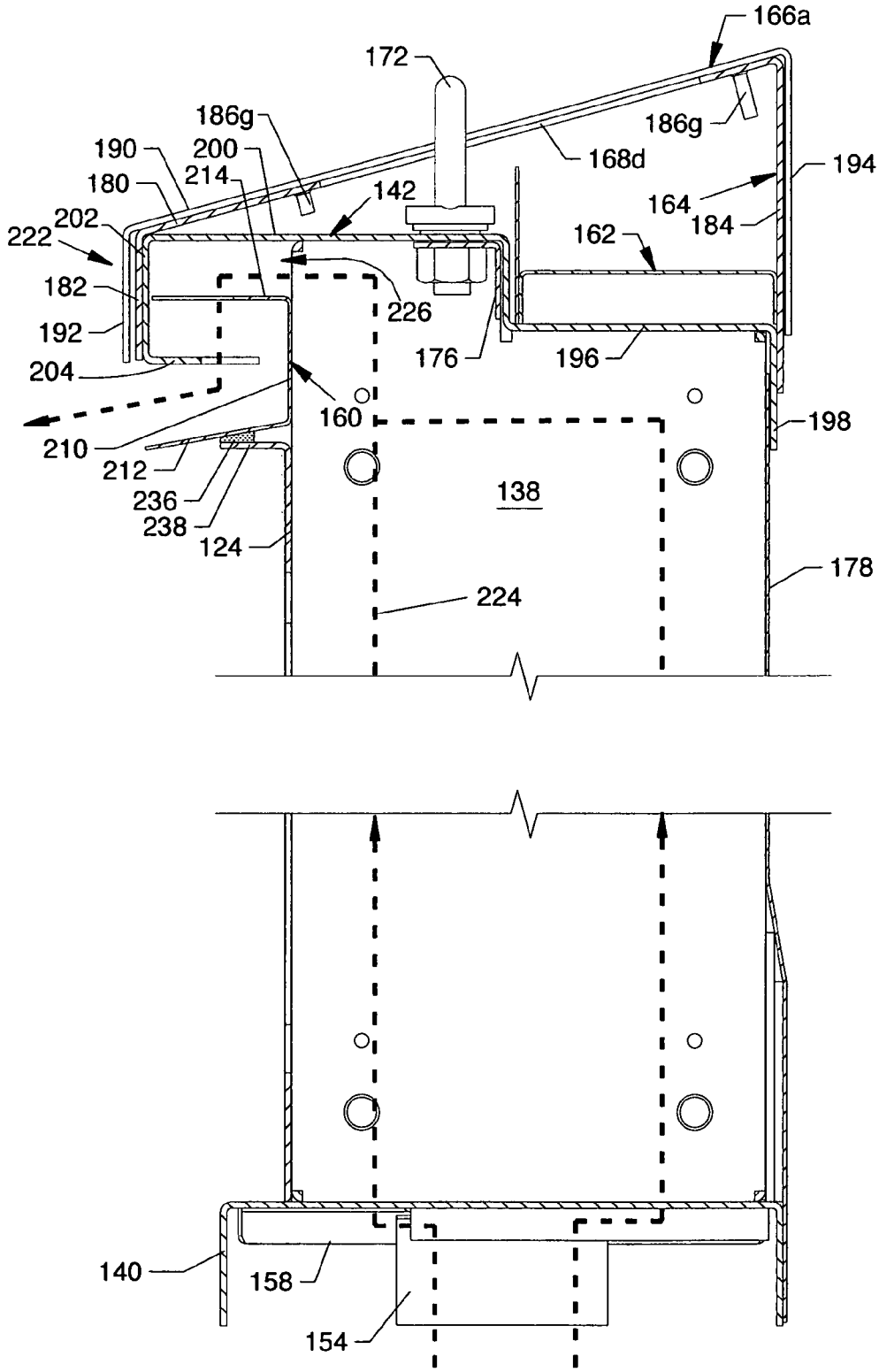

Components at the upper region of the invention are provided to allow exhausting of ventilation air, for suitable washing of the upper region. Configured components at the upper region include the top vent channel 142, a front vent channel 160, a horizontally aligned cable support channel 162, a protective shroud support 164, and one or more protective shrouds 168*a*-168*d* of several standardized sizes. A plurality of access openings including access opening 168*a*, 168*b*, 168*c* and 168*d* are distributed uniformly along the protective shroud support 164 for access to wiring cables, hardware, and the like. A plurality of gaskets (not shown) are included about the access openings 168*a*-168*d*. A plurality of nut inserts are included beneath the protective shroud support 164 for rapid and easy fastening of the protective shrouds 166*a*-166*d* thereto using machine screws. Removable eyebolts 170 and 172 and other associated hardware and mounting brackets 174 and 176 are also included where the removable eyebolts 170 and 172 are accessible through the access openings 168*a* and 168*d*. The removable eyebolts 170 and 172 are used for suspension during installation and removed thereafter and covered subsequently by installation of one or more of the protective shrouds 166*a* and 166*d* as applicable to each installation. One end of such components is shown in detail in FIG. 12 and a cross section view is shown in FIG. 15. An enclosure rear panel 178 is also included which secures to the rear of the partial width mid-panels 126, 128, 130 and 132, the full width mid-panels 134, 136 and 138, the left and right border panels 144 and 146, and the vertically aligned cable channel 150.

Figure 12:
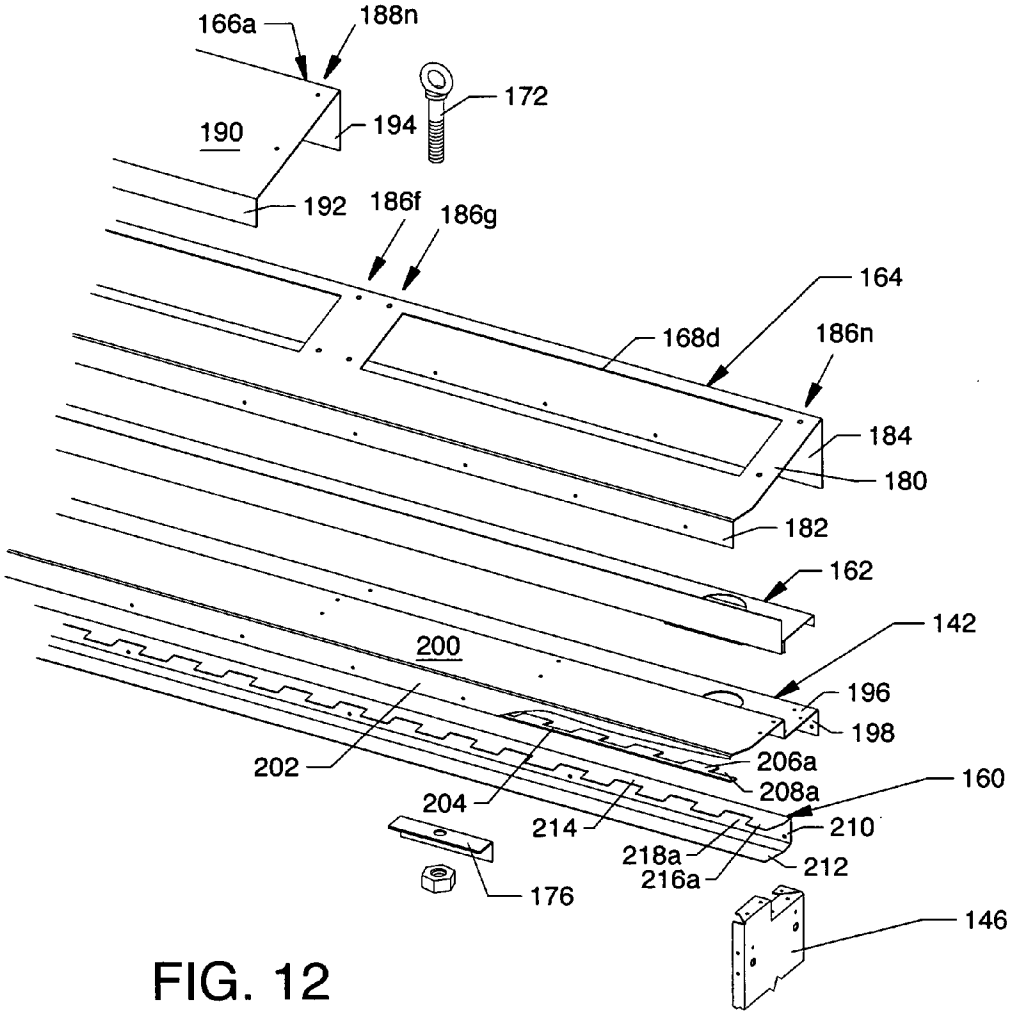
FIG. 12 is an exploded isometric view of one end of the components at the top portion of the invention illustrating the geometry thereof.
Figure 13:
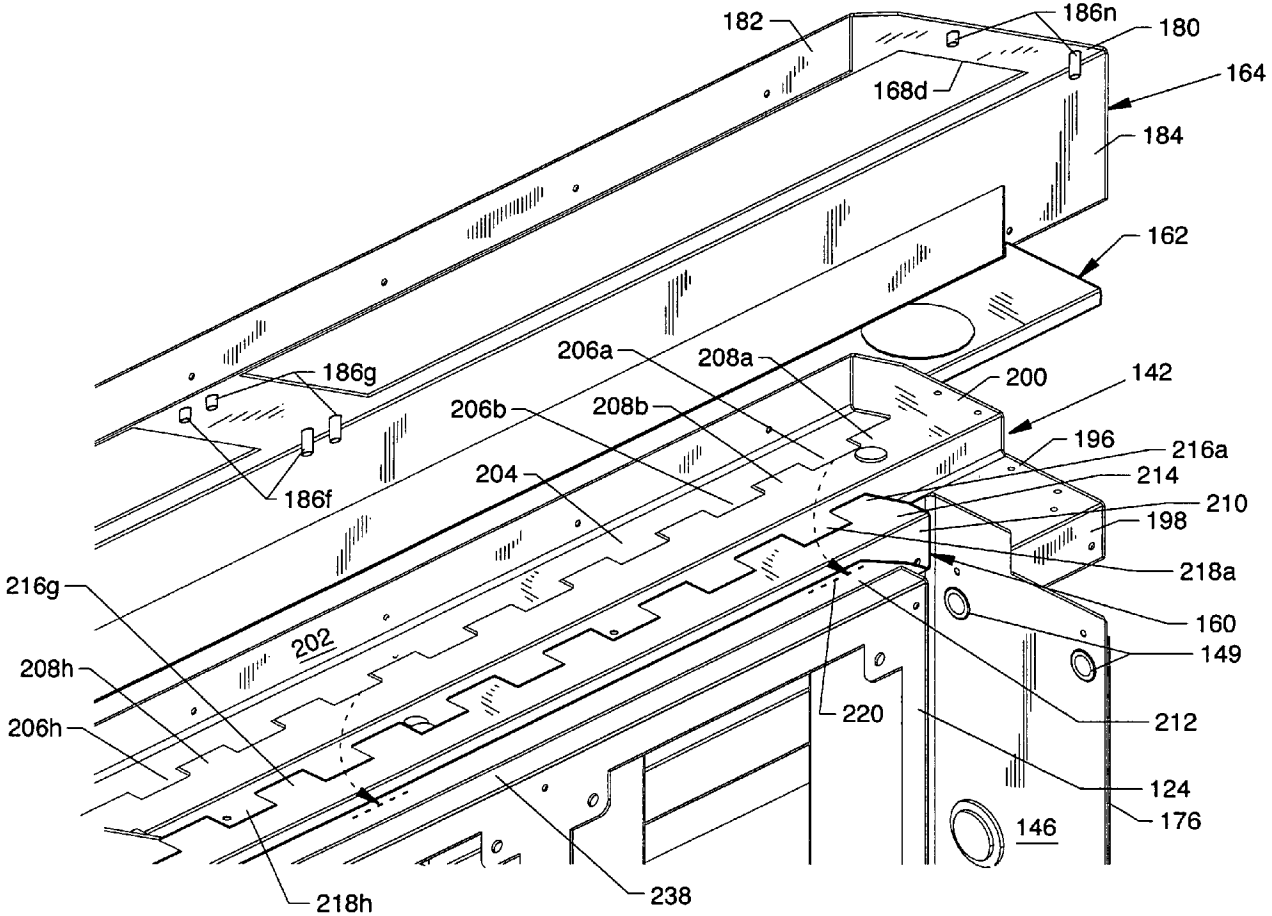
FIG. 13 is an isometric view showing the structure of the top vent channel distanced from the structure of the front vent channel.

FIG. 12 is an exploded isometric view of one end of the components at the top portion of the invention illustrating the geometry thereof, and FIG. 13 is an isometric view showing the structure of the top vent channel 142 distanced from the structure of the front vent channel 160. The protective shroud support 164 includes an angled top panel 180 having the access opening 168*a*, 168*b*, 168*c* and 168*d* which extends therethrough and a vertically aligned front panel 182 and a vertically aligned back panel 184. Groups of nut inserts 186*a*-

186*n* (FIG. 10) are suitably and uniformly arranged and spaced on the underside of the protective shroud support 164 about the access openings 168*a*, 168*b*, 168*c* and 168*d*. Such a suitably and uniformly arranged and spaced arrangement provides for commonality and uniform location of nut inserts 186*a*-186*n* (FIG. 15) which are in concert with suitably and uniformly arranged and spaced groups of body holes 188*a*-188*n* (for machine screw accommodation) which can be of different quantity which are distributed along an angled top panel 190 of one or more of the protective shrouds 166*a*-166*d*. The protective shrouds 166*a*-166*d* include a vertically aligned front panel 192 and a vertically aligned back panel 194. The horizontally aligned cable support channel 162 aligns between the bottom of the protective shroud support 164 and to a lower panel 196 of the top vent channel 142. The top vent channel 142, shown in partial cutaway view, also includes a vertically aligned back panel 198, a top panel 200, a vertically aligned front panel 202, and a horizontally aligned vent panel 204. The vent panel 204 includes rearwardly directed vent tabs 206*a*-206*n* alternating with rearwardly directed vent spaces 208*a*-208*n*. The front vent channel 160 includes a vertically aligned rear panel 210, an angled drip panel 212 extending from the bottom of the rear panel 210, and a horizontally aligned top panel 214 extending forwardly from the top of the rear panel 210. The top panel 214 includes forwardly directed vent tabs 216*a*-216*n* alternating with forwardly directed vent spaces 218*a*-218*n*. Noted in particular is the alignment of the inner edge of the vent tab 206*a* which extends inwardly from the vent panel 204 of the top vent channel 142 to interlacingly align in a spaced relationship, as shown by a dashed arrow, to the rear panel 210 of the front vent channel 160 at a location represented by dashed line 220 (FIG. 13) where such a location and other like locations are distanced substantially along the mid-portion of the rear panel 210. All of the vent tabs 206*a*-206*n* and included vent spaces 208*a*-208*n* have the same relationship and align in the same manner with respect to the mid-portion of the rear panel 210 and, as such, the tabs 206*a*-206*n*, and included vent spaces 208*a*-208*n* extend inwardly from the vent panel 204 of the top vent channel 142 and maintain a vertical spaced relationship and a horizontal offset relationship with and below the vent tabs 216*a*-216*n* and included vent spaces 218*a*-218*n* extending outwardly from the top panel 214 of the front vent channel 160, as shown in FIGS. 14 and 15.

Figure 14:
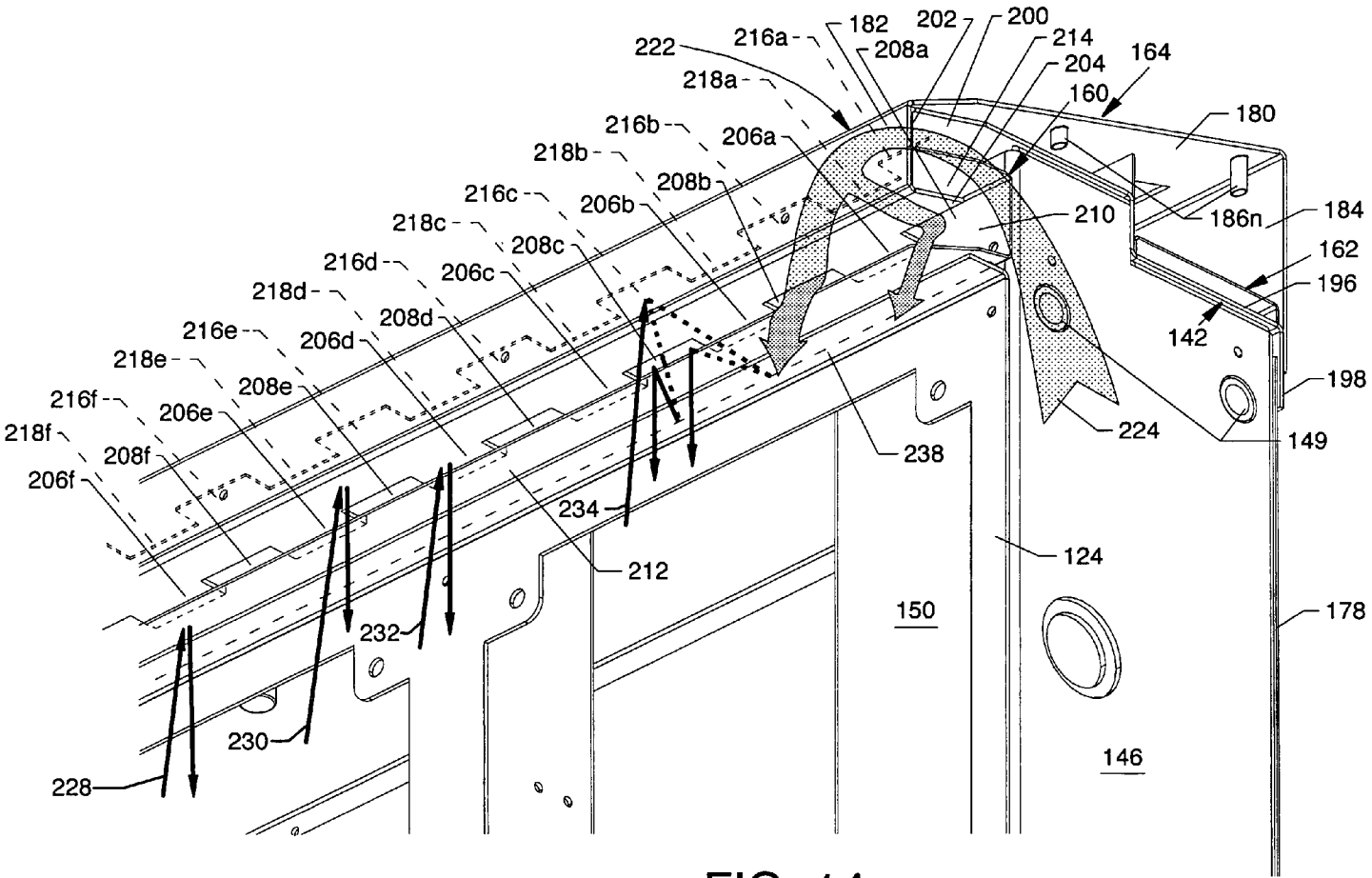
FIG. 14 is a partial view of the forward upper region of the invention showing airflow therethrough; and, FIG. 15 is a cross section view of the ventilated washable electronic sign display enclosure along line 15-15 of FIG. 10.

FIG. 14 is a partial view of the forward upper region of the invention including the top vent channel 142, the protective shroud support 164, and the front vent channel 160 secured to the right border panel 146 in close association with and in interlaced alignment in the manner described in FIG. 13 to form, in part, an exhaust duct 222. The exhaust duct 222, also shown in FIG. 15, is formed by the interlaced components in combination consisting of: the forward region of the top vent channel 142 including the forward part of the top panel 200, the front panel 202, the vent panel 204, the vent tabs 206*a*-206*n*, the vent spaces 208*a*-208*n*, and a greater portion of the front vent channel 160, including the upper portion of the rear panel 210, the top panel 214, the vent tabs 216*a*-216*n*, and the vent spaces 218*a*-218*n*.

The relationship of the components of the exhaust duct 222 is multi purpose in nature. One purpose is to allow exhaust air to be forced through the structure of the exhaust duct 222. Another purpose is to allow streams of jetted water to come into intimate contact with the outer regions of the ventilated washable electronic sign display enclosure 120, such as in close proximity to the exhaust duct 222, for the purpose of cleaning, and also to dissuade or prevent the infusion of such jetted water into the exhaust duct 222 and upper regions of the enclosure.

As also shown in FIG. 15, a typical path of exhaust airflow 224, such as can occur at other locations along the length of the exhaust duct 222, traverses from a mid-location within the invention enclosure to pass horizontally and through an elongated airflow space 226 located between the top panel 214 of the front vent channel 160 and the forward region of the top panel 200 of the top vent channel 142, then along and about and thence between the vent tabs 216*a* and 216*b* through vent space 218*a*, then about the vent tab 206*a* and through the vent spaces 208*a* and 208*b* at the sides of the vent tab 206*a* to the region overlying the angled drip panel 212 and thence to ambient.

Several relationships dissuade, minimize or prevent entry of directed water streams into the interior regions of the exhaust duct 222. In one relationship, a first water stream encounter situation, a water stream 228 impinges and is deflected by the angled drip panel 212 of the front vent channel 160 away from entry into the internal regions of the exhaust duct 222.

Other relationships occur where the horizontal offset relationship of the vent tabs and vent spaces is such that each vent space is spacingly aligned to a vent tab.

A second water stream encounter situation is effected by the continuous portion of the vent panel 204 outboard of the spaced vent tabs 206*a*-206*n* and vent spaces 208*a*-208*n* where a directed water stream 230 impinges and is deflected away from entry into the internal regions of the exhaust duct 222. In such a situation, the continuous outboard portion of the vent panel 204 is interferingly located in the path of the incoming water stream 230 aimed at the exhaust duct 222 to stem the water stream flow thereinto. In the illustration, the outboard portion of the vent panel 204 blocks the flow of water stream 230 into the vent space 216*e*.

A third water stream encounter situation is effected by the spaced vent tabs 206*a*-206*n* where a directed water stream 232 impinges and is deflected by one of the closely located spaced vent tabs 206*a*-206*n* away from entry into the internal regions of the exhaust duct 222. In such a situation, the horizontal offset relationship of the vent tabs 206*a*-206*n* of the top vent channel 142 to the vent spaces 218*a*-218*n* of the front vent channel 160 is such that the vent tabs 206*a*-206*n* are interferingly located in the path of the incoming water stream 232 to block the water stream flow to the vent spaces 218*a*-218*n* to thus stem the water stream flow thereinto. In the illustration, vent tab 206*d* blocks the flow of water stream 232 into vent space 218*d*.

A fourth water stream encounter situation is effected by vent tabs 216*a*-216*n* where a directed water stream 234 impinges and is deflected where the water stream 234 passes through one of the vent spaces 208*a*-208*n*. In such a situation, the aligned relationship of the vent tabs 216*a*-216*n* of the front vent channel 160 to the vent spaces 208*a* 208*n* of the top vent channel 142 is such that the vent tabs 216*a*-216*n* are interferingly located in the path of the incoming water stream 234 to block the water stream flow aimed through the vent spaces 208*a*-208*n* to thus stem the flow of the water stream 234 into the interior of the enclosure. In the illustration, the water stream 234 passes through the vent space 208*c* where the flow of the water stream 234 is blocked by the vent tab 216*c* from flowing into the interior of the enclosure. Drainage of the deflected flow of the water stream 234 can take place directly through the vent space 208*c* or can flow along a vent tab 206*b* (or vent tab 206*c*) where in either case the flow can continue overboard along the angled drip panel 212, as shown.

A fifth water stream encounter situation is effected by the front panel 192 of one of the protective shrouds 166*a*-166*d* (not illustrated) where the front panel 192 is interferingly located in the path of an incoming water stream to block the water stream flow where the aimed water stream impinges and is deflected to dissuade or prevent entry of the water stream flow into structure behind the front panel 192, such as, but not limited to, the plurality of vent tabs 216*a*-216*n* and the plurality of vent spaces 218*a* 218*n*.

FIG. 15 is a cross section view of the ventilated washable electronic sign display enclosure 10 along line 15-15 of FIG. 10. The LED modules 122*a*-122*n* are not shown for purposes of brevity and clarity. Airflow 224, in general, through the structure is shown by dashed lines and arrows where ventilation air enters through the fans 154 and the filter assemblies 158 through the interior of the enclosure structure, through the elongated airflow space 226 and thence through the appropriate portions of the exhaust duct 222, as also shown in detail in FIG. 14. A flexible seal 236 is also shown between the angled drip panel 212 of the front vent channel 160 and a flange 238 of the LED mounting plate 124.

MODE OF OPERATION OF ANOTHER EMBODIMENT OF THE PRESENT INVENTION

One or more of the ventilated washable electronic sign display enclosures 120 can be factory assembled using the teachings of the invention and delivered to a site virtually ready for installation. Rapid construction of the invention is made possible by the use of formed components where precision bending, cutting, or otherwise producing a close tolerance fitting and mating of components and fastening by the use of rivets for components which are stationary in nature or by the use of machine screws and nut inserts for those components which are non-stationary or which may require accessing during or after construction. The use of formed components produces structure which is uniform, true and precise, thereby minimizing enclosure warping or deformation. In FIGS. 9 and 10, the relationship of the protective shroud support 164 and the plurality of protective shrouds 166*a*-166*n*, of which 166*a*-166*c* are shown, allows for rapid construction and site adaptability where protective shrouds 166*a*-166*c*, or of other interchangeable protective shrouds in a plurality of shroud groups protective shrouds 166*a*-166*n*, provide flexibility and adaptiveness due to the commonality. For example, in the protective shroud support 164, the distance of the nut insert set 186*a* to the nut insert set 186*b* is the same as the distance of the nut insert set 186*c* to the nut insert set 186*d*, and so forth, and the distance of the nut insert sets 186*b* to 186*c* is the same as the distance of the nut insert sets 186*d* to 186*e*, and so forth, to provide for uniform alignment with corresponding body holes 188*a*-188*n* in each of the protective shrouds 166*a*-166*c*. For example, as shown in FIGS. 9 and 10, the nut insert sets 186*a*-186*n* associated with the ventilated washable electronic sign display enclosure 120 can accommodate protective shrouds 166*a*-166*c* of several uniform lengths in several ways. For example, the protective shroud 166*a* aligns over and about the access openings 168*b* and 168*c* of the protective shroud support 164 of the ventilated washable electronic sign display enclosure 120 to involve the alignment of the body holes 188*a*-188*n* of the protective shroud 166*a* with the nut inserts 186*c*-186*f* of the protective shroud support 164 where machine screws are used to provide easily accomplished fastening. In an associated fashion, the protective shroud 166*b* can be used to bridge the ventilated washable electronic sign display enclosure 120 and ventilated washable electronic sign display enclosure 120*a*. The protective shroud 166*b* aligns over and about the access opening 168*d* at the protective shroud support 164 of the ventilated washable electronic sign display enclosure 120 and over and about the access opening 168*a* at the protective shroud support 164 of the ventilated washable electronic sign display enclosure 120*a* utilizing the body holes 188*a*-188*b* thereof in alignment with the nut inserts 186*g*-186*n* of the ventilated washable electronic sign display enclosure 120 and utilizing the body holes 188*c*-188*n* in alignment with the nut inserts 186*a*-186*b* of the ventilated washable electronic sign display enclosure 120*a*. A shortened protective shroud 166*c* is used at one end of the ventilated washable electronic sign display enclosure 120, again utilizing the standardized mounting scheme. The protective shroud 166*c* aligns over and about the access opening 168*a* at the protective shroud support 164 of the ventilated washable electronic sign display enclosure 120 utilizing the body holes 188*a*-188*b* thereof in alignment with the nut inserts 186*a*-186*b* of the ventilated washable electronic sign display enclosure 120. Other combinations utilizing protective shroud constructed according to the teachings of the invention can also be utilized in other configurations. Ventilated washable electronic sign display enclosures 120, 120*a*, 120*n* can be virtually completed for delivery to a site utilizing the invention; i.e., the ventilated washable electronic sign display enclosures can be provided, much the same as shown in FIG. 9, where not all of the protective shrouds not installed. Such a configuration allows ready access to the removable eyebolts 170 and 172 which are accessible through the access openings 168*a* and 168*d*, respectively, so that the ventilated washable electronic sign display enclosure 120 may be suspended as part of an installation process, whereby attachment is made between the ventilated washable electronic sign display enclosure 120 and external support structure. Subsequent to installation, the eyebolts 170 and 172 are removed through the access openings 168*a* and 168*d* and the protective shrouds 166*c* and 166*b* can then installed, as previously described.

Various modifications can be made to the present invention without departing from the apparent scope thereof.

It is claimed:

1. A display enclosure assembly comprising:

a display enclosure, including a front side portion, couplable to or integrated with an exposed electronic sign display, and a back side portion; and an intake duct and an exhaust duct, wherein the intake duct or the exhaust duct is formed using stationary components, and wherein at least one of the intake duct or the exhaust duct is located along the front side portion, and wherein the intake duct or the exhaust duct is formed by a front vent channel, including one or more horizontally aligned vent tabs alternating with interceding horizontally aligned vent spaces, and a vertically aligned front panel including one or more vent orifices, the vent orifices aligned above the one or more horizontally aligned vent tabs;

wherein one or both of the intake duct or the exhaust duct is geometrically configured to prevent or dissuade entry of one or more fluid streams to an interior of the display enclosure, while maintaining adequate ventilation thereof.

2. The display enclosure assembly of claim 1, wherein both the intake duct and the exhaust duct are located along the front side portion.

3. The display enclosure assembly of claim 1, comprising one or more internal fans configured to facilitate flow of the ventilation air stream from the intake duct to the exhaust duct.

4. The display enclosure assembly of claim 3, wherein the one or more internal fans are configured to draw the ventilation air stream into the intake duct, through at least a portion of the interior of the display enclosure, and out the exhaust duct.

5. The display enclosure assembly of claim 1, wherein the intake duct or the exhaust duct is located at or near a lower edge of the display enclosure.

6. The display enclosure assembly of claim 1, wherein the exhaust duct is located at or near an upper edge of the display enclosure.

7. The display enclosure assembly of claim 6, comprising an angled drip panel located at the upper edge and oriented to dissuade or prevent entry of the one or more fluid streams to the interior of the display enclosure.

8. The display enclosure assembly of claim 1, comprising one or more weep holes for drainage of errant moisture within the interior of the display enclosure.

9. The display enclosure assembly of claim 1, comprising at least a first display enclosure and an adjacent second display enclosure.

10. The display enclosure assembly of claim 1, comprising one or more LED mounting plates configured to mount and support one or more LED modules.

11. The display enclosure assembly of claim 1, comprising one or more filter assemblies intersecting a ventilation air stream flowing between the intake duct and the exhaust duct.

12. A display enclosure assembly comprising:

a display enclosure, including a front side portion, couplable to or integrated with an exposed electronic sign display, and a back side portion; and an intake duct and an exhaust duct, wherein at least one of the intake duct or the exhaust duct is located along the front side portion;

wherein one or both of the intake duct or the exhaust duct is geometrically configured to prevent or dissuade entry of one or more fluid streams to an interior of the display enclosure, while maintaining adequate ventilation thereof, and further comprising a protective shroud support disposed along an upper region of the display enclosure, the protective shroud support including at least one access opening.

13. The display enclosure assembly of claim 12, comprising one or more protective shrouds coupled to the protective shroud support, the protective shrouds having an angled top panel to promote drainage of fluids.

14. A display enclosure assembly comprising:

a display enclosure, including a front side portion, couplable to or integrated with an exposed electronic sign display, and a back side portion; and an intake duct and an exhaust duct, wherein at least one of the intake duct or the exhaust duct is located along the front side portion;

wherein one or both of the intake duct or the exhaust duct is geometrically configured to prevent or dissuade entry of one or more fluid streams to an interior of the display enclosure, while maintaining adequate ventilation thereof;

wherein the display enclosure assembly comprises at least a first display enclosure and an adjacent second display enclosure, and further comprises a protective shroud configured to bridgingly extend over and about the adjacent first and second display enclosures.

15. A method comprising:

receiving a ventilation air stream into an interior of a display enclosure, the display enclosure couplable to or including an externally exposed electronic sign display, wherein the ventilation air stream enters via an intake duct, the intake duct including an interfering and shielding intake configuration in which entry of fluid streams to the interior of the display enclosure is inhibited, while maintaining adequate ventilation therethrough;

cooling the interior of the display enclosure; and exhausting the ventilation air stream out of the display enclosure via an exhaust duct, including providing an interfering and shielding exhaust configuration in which entry of fluid streams to the interior of the display enclosure is inhibited, while maintaining adequate ventilation therethrough;

wherein receiving the ventilation air stream into the intake duct and providing the interfering and shielding intake configuration includes passing the ventilation air stream through one or more horizontally aligned vent spaces, located on a front vent channel, and upwardly, sideways and inwardly through one or more vent orifices, located on a vertically-aligned front panel.

16. The method of claim 15, wherein cooling the interior of the display enclosure includes cooling one or more electronic components housed within the display enclosure.

17. The method of claim 15, wherein receiving the ventilation air stream into the intake duct includes drawing the ventilation air stream using one or more internal fans.

18. The method of claim 15, wherein cooling the interior of the display enclosure includes receiving the ventilation air stream into a lower edge portion of the display enclosure and exhausting the ventilation air stream out of the display enclosure at an upper edge portion of the display enclosure.

19. The method of claim 15, comprising promoting fluid drainage along an upper region of the display enclosure using one or more protective shrouds having an angled top panel.

20. The method of claim 15, wherein cooling the interior of the display enclosure includes passing the ventilation air stream through one or more filter assemblies.

* * * * *